US006751164B1

(12) United States Patent
Sekiguchi

(10) Patent No.: US 6,751,164 B1
(45) Date of Patent: Jun. 15, 2004

(54) TIME PIECE

(75) Inventor: Kanetaka Sekiguchi, Sayama (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/786,975

(22) PCT Filed: Jul. 17, 2000

(86) PCT No.: PCT/JP00/04800

§ 371 (c)(1),
(2), (4) Date: Mar. 13, 2001

(87) PCT Pub. No.: WO01/06329

PCT Pub. Date: Jan. 25, 2001

(30) Foreign Application Priority Data

Jul. 16, 1999 (JP) ..... 11-202656

(51) Int. Cl.[7] ..... G04B 19/04; G04B 19/22; G04C 11/02

(52) U.S. Cl. ..... 368/80; 368/47; 368/55; 368/21

(58) Field of Search ..... 368/47, 51, 55, 368/60–61, 10, 107–113, 21, 22

(56) References Cited

U.S. PATENT DOCUMENTS

| | | | | |
|---|---|---|---|---|
| 4,800,543 A | | 1/1989 | Lyndon-James et al. | |
| 5,105,396 A | * | 4/1992 | Ganter et al. | 368/47 |
| 5,172,348 A | * | 12/1992 | Paratte | 368/47 |
| 5,329,501 A | | 7/1994 | Meister et al. | |
| 5,331,608 A | * | 7/1994 | Umemoto et al. | 368/10 |
| 5,479,378 A | * | 12/1995 | Yamada et al. | 340/7.55 |
| 6,522,601 B2 | * | 2/2003 | Sakuyama | 368/47 |

FOREIGN PATENT DOCUMENTS

| | | |
|---|---|---|
| EP | 0 581 957 B1 | 1/1996 |
| EP | 0 766 150 A1 | 4/1997 |
| JP | 50-153679 | 12/1975 |
| JP | 51-136452 | 11/1976 |
| JP | 52-66369 | 5/1977 |
| JP | 54-100664 | 12/1977 |
| JP | 55-70777 | 5/1980 |
| JP | 60-21477 | 2/1985 |
| JP | 63-236410 | 10/1988 |
| JP | 2-2974 | 1/1990 |
| JP | 5-6393 | 1/1993 |
| JP | 6-28780 | 4/1994 |
| JP | 6-207991 | 7/1994 |
| JP | 3028031 | 6/1996 |
| JP | 9-90066 | 4/1997 |

* cited by examiner

*Primary Examiner*—David Martin
*Assistant Examiner*—Michael L. Lindinger
(74) *Attorney, Agent, or Firm*—Westerman, Hattori, Daniels & Adrian, LLP

(57) ABSTRACT

A timepiece (1) comprises communication means (2) and hand haft control means (19), executes function processing on the basis of information acquired from an external apparatus via the communication means (2), and controls operation of respective hand shaft blocks (28, 29, 30) of the timepiece (1) via the hand shaft control means (19), so that a variety of information can be displayed under various assignments and in a display mode optionally designated by the external apparatus.

21 Claims, 17 Drawing Sheets

TIME PIECE

TECHNICAL FIELD

The invention relates to a timepiece comprising communication means for performing exchange of information with an external apparatus, and in particular, to a timepiece (mainly wrist watch) capable of changing functions of the timepiece on the basis of information acquired from the external apparatus via the communication means.

BACKGROUND TECHNOLOGY

With a conventional timepiece, a user who has purchased the timepiece has been able only to sequentially execute functions stored in a read-only memory (ROM) incorporated therein by pushing switching buttons in a predetermined order. Accordingly, he has had to execute even unwanted functions at times because it has been impossible to render parts of the functions temporarily inoperative. Needless to say, it has been impossible for the user to arbitrarily change the order of function selection so as to suit to the user's convenience.

It has also been impossible for the user to freely assign display of hand shafts to respective hands, to change a pitch at which the respective hands are handled, and a speed of the respective hands, and to change a rotation direction and a rotation angle of the respective hands.

The invention has been developed in view of such a present situation as described above, and it is therefore an object of the invention to provide a timepiece capable of variously changing the functions of the timepiece as necessary on the basis of information communicated from an external apparatus, in particular, changing movements of respective hands and information displayed by the respective hands, in response to preferences and needs of the user.

DISCLOSURE OF THE INVENTION

A timepiece according to the invention is a timepiece comprising communication means for exchanging information with an external apparatus, and in order to achieve the object as described above, the timepiece comprises function selection means capable of changing functions of the timepiece on the basis of information acquired from the external apparatus via the communication means, and a hand shaft control means for controlling movement of hand shafts of the timepiece in response to an instruction for function change given by the function selection means.

Further, the timepiece as described above may comprise a plurality of hand shaft blocks, each comprising at least one or more hand shafts, wherein the hand shaft control means is a means for controlling a hand shaft or hand shafts of some hand shaft blocks among the plurality of the hand shaft blocks in response to the instruction for the function change given by the function selection means, and for controlling a hand shaft or hand shafts of the rest of the hand shaft blocks on the basis of internal information of the timepiece not associated with the information acquired from the external apparatus.

Further, the timepiece preferably comprises a display means for displaying types of information displayed by a hand of the hand shafts controlled by the hand shaft control means in response to the instruction for the function change given by the function selection means.

The timepiece may further comprise a means for making the hand shaft control means to control the hand shafts so as to display with a hand thereof that the communication means is in use for communication when the communication means is in communication with the external apparatus.

Further, the timepiece may further comprise a means for making the display means to display that the communication means is in use for communication when the communication means is in communication with the external apparatus.

The timepiece may further comprise a chargeable battery for supplying electric power to be used internally, and in the case of the communication means being wired communication means capable of receiving electric power from the external apparatus, a charging means for charging the battery by receiving supply of electric power from the external apparatus when the communication means is in communication with the external apparatus may be installed.

Further, the timepiece preferably comprises a power generation means such as a solar cell, enabling the battery to be chargeable all the time by the charging means.

The timepiece preferably comprises means for reducing power consumption by restricting control on the hand shafts operated by the function selection means and the hand shaft control means when the amount of electrical energy that remains in the battery falls short of a predetermined amount.

Furthermore, the timepiece preferably comprises a means for displaying a state of charging when the battery is being charged by the charging means while the communication means is in communication with the external apparatus.

Or in such a case, the timepiece may further comprise a means for making the hand shaft control means to control the hand shaft so as to display a state of charging with a hand thereof.

The hand shaft control means preferably comprises a means for controlling the hand shafts so as to change any of a rotation direction, rotation angle, reciprocating movement, rotation speed of hands, a pitch at which the hands are handled, in response to the instruction for function change given by the function selection means.

For the communication means, an optical communication means for performing exchange of information with the external apparatus by utilizing light may be used.

If the optical communication means is disposed on the underside of a time display face, and exchange of information with the external apparatus is performed by the agency of light outgoing through and incident on the time display face, this will be preferable from a design point of view because the optical communication means become invisible directly from outside.

In case of a hand being in a position blocking light outgoing through and incident on the time display face upon start of communication via the optical communication means, the hand shaft control means is preferably made to control the hand shaft of the hand so as to cause the hand to withdraw to a position not blocking the light.

The timepiece preferably comprises display means for displaying types of information displayed by a hand of the hand shafts controlled by the hand shaft control means in response to the instruction for function change given by the function selection means, so that at least part of the display means is caused to stop displaying when the optical communication means are in communication.

The timepiece may further comprise a sensor for measuring information associated with an application environment of the timepiece, and a means for making the hand shaft control means to control the hand shafts so as to display the information measured by the sensor with the hand of the hand shafts.

Or the timepiece may further comprise the sensor for measuring information associated with the application environment of the timepiece, so that any of the hand shaft blocks to be controlled on the basis of internal information of the timepiece among the plurality of the hand shaft blocks is selected, and the hand shaft control means is made to control the hand shaft or the hand shafts of the hand shaft blocks as selected so as to display the information measured by the sensor with the hand of the hand shaft or the hand shafts.

Further, the timepiece preferably comprises testing means for making the hand shaft control means to control the movement of the hand shafts on a trial basis for short duration on the basis of the information acquired from the external apparatus during or after communication via the communication means.

Operation

With the timepiece constituted as above, the functions of the timepiece can be changed by the function selection means on the basis of the information acquired from the external apparatus via the communication means, and it is possible to cause the hand shafts of the timepiece to make movement according to contents based on external information by transmitting the information to the hand shaft control means. That is, the movement of the hand shafts, required by a user, is enabled.

Further, in the case of the so-called multi-hand type analog timepiece provided with a plurality of the hand shaft blocks, each comprising at least one or more hands, contents to be executed by the function selection means can be changed by either writing the information acquired from the external apparatus via the communication means to the RAM, or by erasing information written in the RAM. Further, since the function selection means transmit information corresponding to the contents of the RAM to the hand shaft control means, contents to be displayed by the respective hand shaft blocks can be changed. That is, the user is able to express information contents assigned to the respective hand shaft blocks on the basis of the external information with the movement of the hand of the respective hand shaft blocks.

Furthermore, in the case where the timepiece comprises a large number of the hand shaft blocks, it will result in an increase in the size, thickness and weight of the timepiece to render the hand shaft control means which controls the hand shaft blocks variable in whole on the basis of the external information, thereby deteriorating portability of the timepiece. Accordingly, with the timepiece according to the invention, a method is adopted whereby expression contents of some hand shaft blocks are rendered variable on the basis of the external information while the rest of the hand shaft blocks are operated on the basis of initial and internal information of the timepiece.

As a result, even with the multi-hand type analog timepiece, efficient expression is enabled without subjecting the timepiece to constraints in terms of designing.

Further, operation of the hand shafts is rendered variable by the agency of the hand shaft control means on the basis of the external information, but auxiliary means are needed whereby expression contents of the hand shafts are displayed upon rendering the expression contents of the hand shafts variable. With the timepiece according to the invention, display means for changing display contents on the basis of a change in the hand shaft control means are provided. For the display means, display means capable of providing digital display such as a liquid crystal display device, an organic electroluminescent (EL) device (matrix display), or so forth is used.

For example, a first hand shaft block displays "TIME" around the hand shaft thereof for expressing time, a second hand shaft block displays "TEMP" for expressing temperature, and a third hand shaft block displays "DEPT" for expressing the depth of water.

Further, in the case of using the timepiece as an altimeter (barometer) on the basis of the external information, the first hand shaft block displays "HEIT" for expressing an altitude, the second hand shaft block displays "N, S, E, W" by every 90 degrees for expressing bearings, and the third hand shaft block displays "TIME" for expressing time.

By operating the timepiece in this way, expression by the respective hand shafts can be freely changed as desired by the user using the timepiece, enabling what is expressed to be clearly displayed.

Furthermore, a driving energy supply source such as a battery or the like is needed to render movement of the hand shafts variable according to the external information, and to control a CPU, the RAM, a ROM, and so forth, however, there arises a restriction of power consumption because the driving energy supply source is disposed in a limited space, that is, the timepiece.

For this reason, there is adopted a method whereby power generation part is installed in the timepiece, or the battery is charged when the timepiece is in communication with the external apparatus. As the timepiece is allowed to be in a particular state while in communication, limitation on a method of charging can be alleviated. For example, a method of charging via a cable, a method of charging through induction, a method of charging by use of thermal energy, a method of charging by use of light, and so forth are available.

Further, the control of the hand shafts by the hand shaft control means is restricted depending on the amount of electrical energy that remains in the battery of the timepiece. More specifically, in the case of the timepiece comprising the plurality of the hand shafts, it is possible to reduce consumption of energy of the battery by providing the timepiece with battery consumption reduction means for reducing the number of the hand shafts driven by the hand shaft control means, or driving only one of the hand shafts.

Even in this case, it is possible to determine the order of stopping the respective hand shafts according to an application purpose on the basis of external information.

Furthermore, the user can set by steps the amount of electrical energy that remains in the battery via the communication means, and thereby can set an alarm level, and a level at which a hand shaft is stopped, simultaneously enabling the amount of electrical energy that remains in the battery or a state of charging to be displayed with any of the hand shaft blocks.

Further, the hand shaft control means enables the rotation direction, rotation angle, reciprocating movement, rotation speed, pitch, and so forth of the hands to be controlled on the basis of the information acquired from the external apparatus via the communication means, thereby enabling the user to enjoy beauty in expression given by the hands of the timepiece.

For example, versatile movements of the hands can be produced by combination of a clockwise rotating hand shaft block, a counterclockwise rotating hand shaft block, a hand shaft block having a fan-shaped rotation angle, and a hand shaft block having a large pitch of movement. Further, it is also possible to produce an atmosphere of reversing time or an atmosphere of time elapsing very fast by rendering the speed at which the hands are handled variable, so that an enjoyable timepiece can be offered.

Furthermore, it is important when considering the design of a timepiece that the communication means are invisible from outside, and the outside shape of the timepiece are not under constraints. To that end, the optical communication means are effective. Further, the optical communication means are disposed on the underside (on the back cover side) of the time display face comprising the hand shaft for executing time display or the display means, causing the hand to withdraw from the region of the optical communication means during communication.

Further, optical noises occurring to the optical communication means are reduced by temporarily stopping display by the display means, thereby improving communication capacity.

Also, the sensor for measuring information associated with the application environment of the timepiece is installed, and signals from the sensor can be transmitted to the hand shaft control means via the function selection means, thereby enabling the information acquired by the sensor to be displayed with the hand of the hand shaft block selected by the user.

Furthermore, by installing the testing means for causing the hand shaft control means to test the information acquired from the external apparatus for a short duration during or after communication, it becomes possible to verify whether or not the timepiece can accurately receive the information acquired from the external apparatus, and respective controls are enabled, so that malfunction can be prevented.

In particular, in the case of a watch used for diving, it is particularly useful to verify whether or not malfunction occurs because there is the need for accurate display of the depth of water, and so forth.

BEST MODE FOR CARRYING OUT THE INVENTION

Preferred embodiments of a timepiece according to the invention are described hereinafter with reference to the accompanying drawings.

First Embodiment: FIGS. 1 to 6

Figure 1:
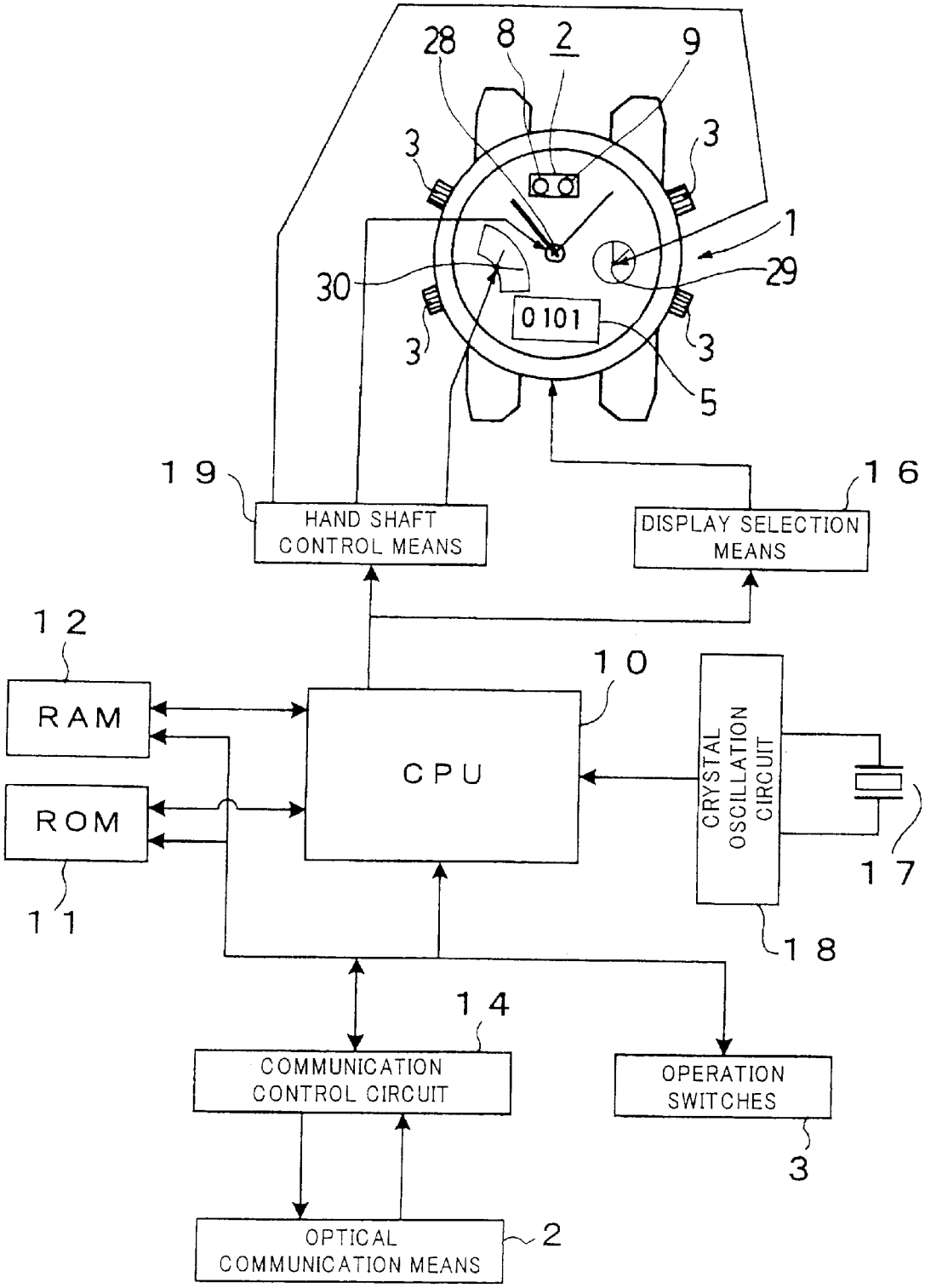
FIG. 1 is a system block diagram of a timepiece comprising communication means and hand shaft control means according to a first embodiment of the invention.
Figure 2:
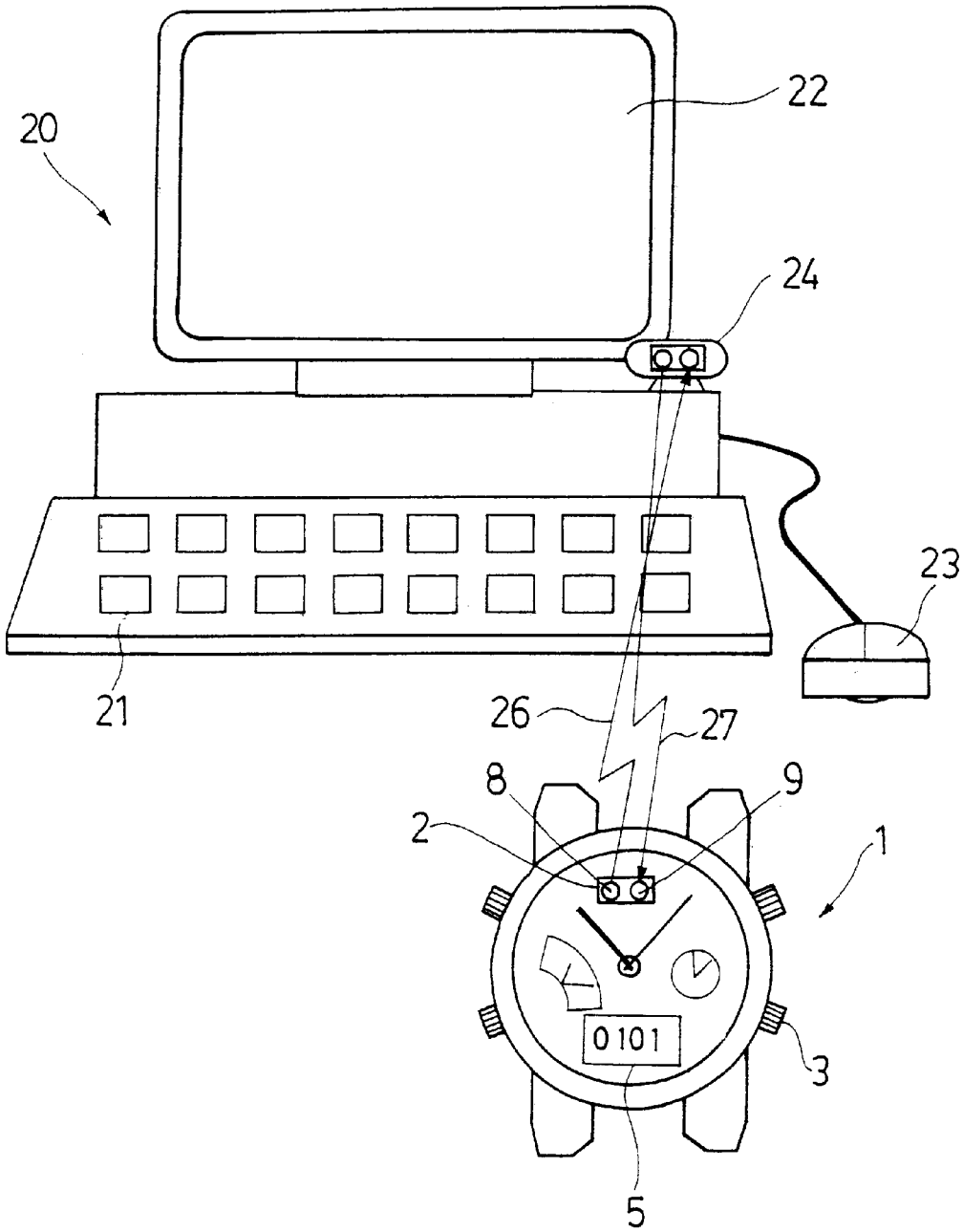
FIG. 2 is a schematic illustration showing a state of communication being performed between the timepiece and an external apparatus.

FIG. 1 is a system block diagram of a timepiece comprising communication means and hand shaft control means according to a first embodiment of the invention. FIG. 2 is a schematic view for illustrating a state of the timepiece performing communication with an external apparatus. Respective blocks shown in FIG. 1 are shown outside of the timepiece 1 for the sake of convenience in illustration, however, all these blocks are in fact installed inside the timepiece 1.

First, the first embodiment of the timepiece according to the invention is broadly described hereinafter with reference to these figures.

As shown in FIG. 1, the timepiece 1 comprises a central processing unit (referred to hereinafter merely as "CPU") 10 for executing and selecting instructions from a user, or for executing and selecting instructions and so forth, stored in a random access memory (RAM) 12, and so froth, incorporated in the timepiece. A microcomputer is made up of the CPU 10 together with the RAM 12 for provisionally holding data, and a read-only memory (ROM) 11 for storing beforehand respective programs for functions executed by the timepiece 1 and fixed data.

The RAM 12 retains data necessary for executing mainly a time display function, and information necessary for processing selection of various functions on the basis of information acquired from an external apparatus at predetermined addresses, respectively.

A clock pulse signal generated according to the natural frequency of a crystal oscillator 17 by a crystal oscillation circuit 18 connected to the CPU 10 undergoes frequency division inside the CPU 10, and is turned into a reference signal for displaying time, updating time data and date data.

The ROM 11 stores programs and data necessary for the time display function and a time correction function. The data stored in the ROM 11 are read in by the CPU 10, and the data as read in are processed within the CPU 10 before outputted to respective function parts.

A liquid crystal display panel 5 is driven by display selection means 16 connected to the CPU 10, performing display such as time display, display of year and date, display of day-of-week, and so forth.

A communication circuit block 14 connected to the CPU 10 performs exchange of information with the external apparatus, using optical communication means 2. The optical communication means 2 is a unit comprising a light emitting device such as a light emitting diode (LED) as transmitting means 8 and a photodetecting device such as a phototransistor as receiving means 9 integral with each other.

Optical communication with the external apparatus is performed under control by the CPU 10 via the optical communication means 2 and the communication circuit block 14, installed inside the timepiece 1.

FIG. 2 shows a state of such optical communication by way of example. An external apparatus 20 is a personal computer comprising input means 21 made up of a keyboard, a monitor 22 made up of a CRT or a liquid crystal display, and a mouse (pointing device) 23, and is provided with a communication adapter 24 serving as an input/output device for optical signals, used in performing optical communication.

The communication adapter 24 and the optical communication means 2 of the timepiece 1 can perform bidirectional processing of optical signals by infrared rays, and so forth, via a transmitting path 26 and a receiving path 27, based on the timepiece 1, respectively.

An optical signal outgoing from the communication adapter 24 of the external apparatus 20 is received by the receiving means 9 of the optical communication means 2 through the glass of the timepiece 1, and is converted into an electric signal before transmitted to the communication circuit block 14 shown in FIG. 1. The communication circuit block 14 converts the electric signal into data processable by the CPU 10, before transmitting the data to the CPU 10 while causing the RAM 12 to retain the same.

On the other hand, the CPU 10 of the timepiece 1 loads the data retained by the RAM 12, and sends the data to the communication circuit block 14, thereby converting the data into an electric signal which is transmittable. The electric signal generates an optical signal by infrared rays by the agency of the transmitting means 8 of the optical communication means 2, and the optical signal outgoes through the glass, thereby transmitting information to the communication adapter 24 of the external apparatus 20.

Further, hand shaft control means 19 for varying a rotation direction, pitch, deflection angle, rotation speed, and so forth of hands of hand shaft blocks 28, 29 and 30, respectively, of the timepiece 1, shown in FIG. 1, supply a signal to a driving circuit of the hand shaft block 28, the hand shaft block 29, and the hand shaft block 30, respectively, on the basis of a signal received from the CPU 10.

Four operation switches 3 are connected with the CPU 10, and upon actuation of any of the operation switches 3 by the user of the timepiece 1, an interrupt function occurs to the CPU 10, whereupon the actuation of the operation switches 3 can be immediately sensed, thereby enabling switchover of the functions of the timepiece 1, switchover of time display, and switchover to a communication mode.

Figure 3:
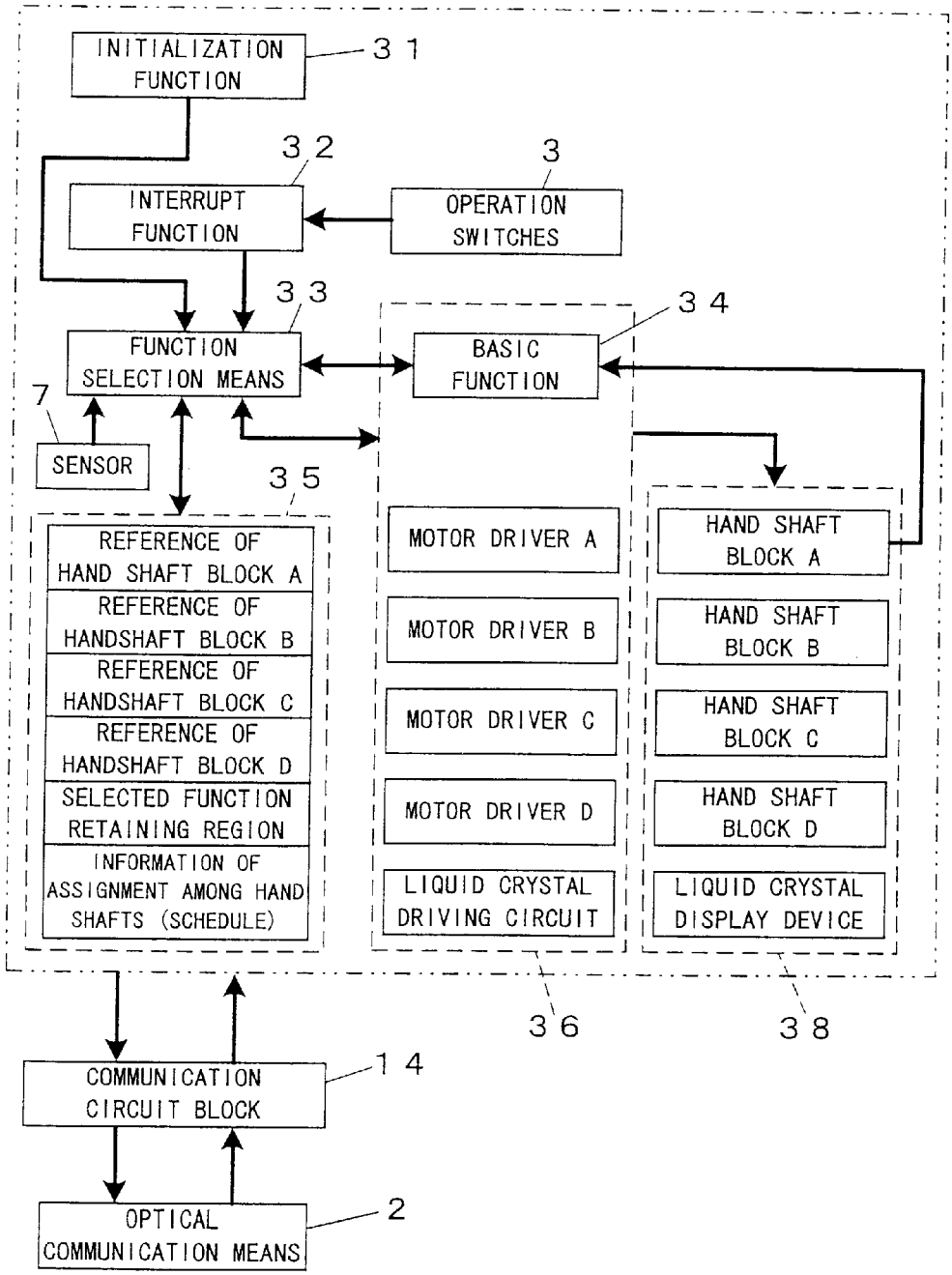
FIG. 3 is a block diagram showing a function constitution of the timepiece for performing function selection thereof.

FIG. 3 is a block diagram showing the constitution of a mechanism for selecting the functions of the timepiece comprising the communication means and the hand shaft control means, and a system for performing function selection of the timepiece, further showing flow of processing after resetting the system.

The constitution for selecting the functions of the timepiece 1 is divided into: means for executing a initialization function 31; means for executing an interrupt function 32 in case an interrupt occurs; function selection means 33; means for executing a basic function 34 that is required to process all the time such as a function for displaying time, a function for displaying date, and so forth; function processing means 36 comprising respective motor drivers A to D which respectively constitute the hand shaft control means for executing functions selected on the basis of information selected by the function selection means 33, and a liquid crystal driving circuit; display function means 38; and an address information table 35 retaining address information for selecting functions existing in regions as designated by the RAM 12.

The display function means 38 comprises respective hand shaft blocks A to D driven by the respective motor drivers A to D of the function processing means 36 for operating a hand of respective hand shafts, and a liquid crystal display panel.

The timepiece 1 after a reset processing is executed performs initialization of the CPU 10 and initialization of the function selection means 33 by executing the initialization function 31 at first, thereby activating the basic function 34. Based on the basic function, the respective motor drivers A to D of the function processing means 36 is put in initial operation.

The timepiece 1 after completing processing of the initialization function 31 executes the function selection means 33. The function selection means 33 loads the initial values of information as set by the initialization function 31, and loads address information for referring to the address information table 35 retaining the address information set in the regions designated in the RAM 12.

In accordance with the address information set in the regions designated in the RAM 12 loaded by the function selection means 33, sequential execution means provided in the function selection means 33 execute selected functions among a plurality of functions provided in the function processing means 36.

The timepiece 1 after completing processing of the selected functions among the plurality of the functions provided in the function processing means 36 by the sequential execution means provided in the function selection means 33 restores the respective hands of the respective hand shaft blocks A to D and the liquid crystal display panel of the display function means 38 to an initial condition.

Subsequently, the hand shafts are rotated from an initial position to a given time, and processing of the basic functions 34 that is required to process all the time such as the function for displaying time, the function for displaying date, and so forth, is performed.

The basic functions 34 are executed without fail upon completion of the processing of any functions among the plurality of the functions provided in the function processing means 36, selected and executed by the sequential execution means provided in the function selection means 33. Upon completion of processing of the basic functions 34, the system reverts to the function selection means 33 again, repeating processing.

Further, upon actuation of the operation switches 3, an interrupt instruction is caused to occur to the CPU 10 by the agency of the interrupt function 32. As a result, the CPU 10 causes the function processing means 36 to execute a function for optical communication by the agency of the function selection means 33.

A signal received by the optical communication means 2 is thereby inputted to the communication circuit block 14, and is converted into data, which is stored in the RAM 12. The data enables the CPU 10 to perform a function change in the function processing means 36, a change in the address information table 35, or a change in the function selection means 33. Accordingly, this enables time, date, schedule, and record of the timepiece 1, or information of an environmental sensor provided in the timepiece 1 to be read out or written in.

In the case of performing communication with the external apparatus via the communication means, the hand shaft block A (28) is rendered to indicate a communicating state. In this case, the minute hand 42 or the hour hand 43 is withdrawn from over the transmitting means (light emitting part) 8 of the optical communication means 2, and is disposed so as to overlap the other hand at the position of one o'clock.

In the case of changing the contents of the RAM 12, verification of whether or not the communication has been normally completed is performed, and in the case of normal completion, operation for restoring the minute hand 42 and the hour hand 43 to the position of the present time is performed. In case of occurrence of an error, the minute hand 42 and the hour hand 43 are shifted to the position of twelve o'clock, and are disposed so as to shield the optical communication means 2.

A sensor 7 in FIG. 3 is a sensor for taking measurement of an external environment, that is, a sensor for measuring temperature, pressure, and so forth. It is also possible to operate the function selection means 33 on the basis of information as measured by the sensor, thereby selecting display of the information.

Figure 4:
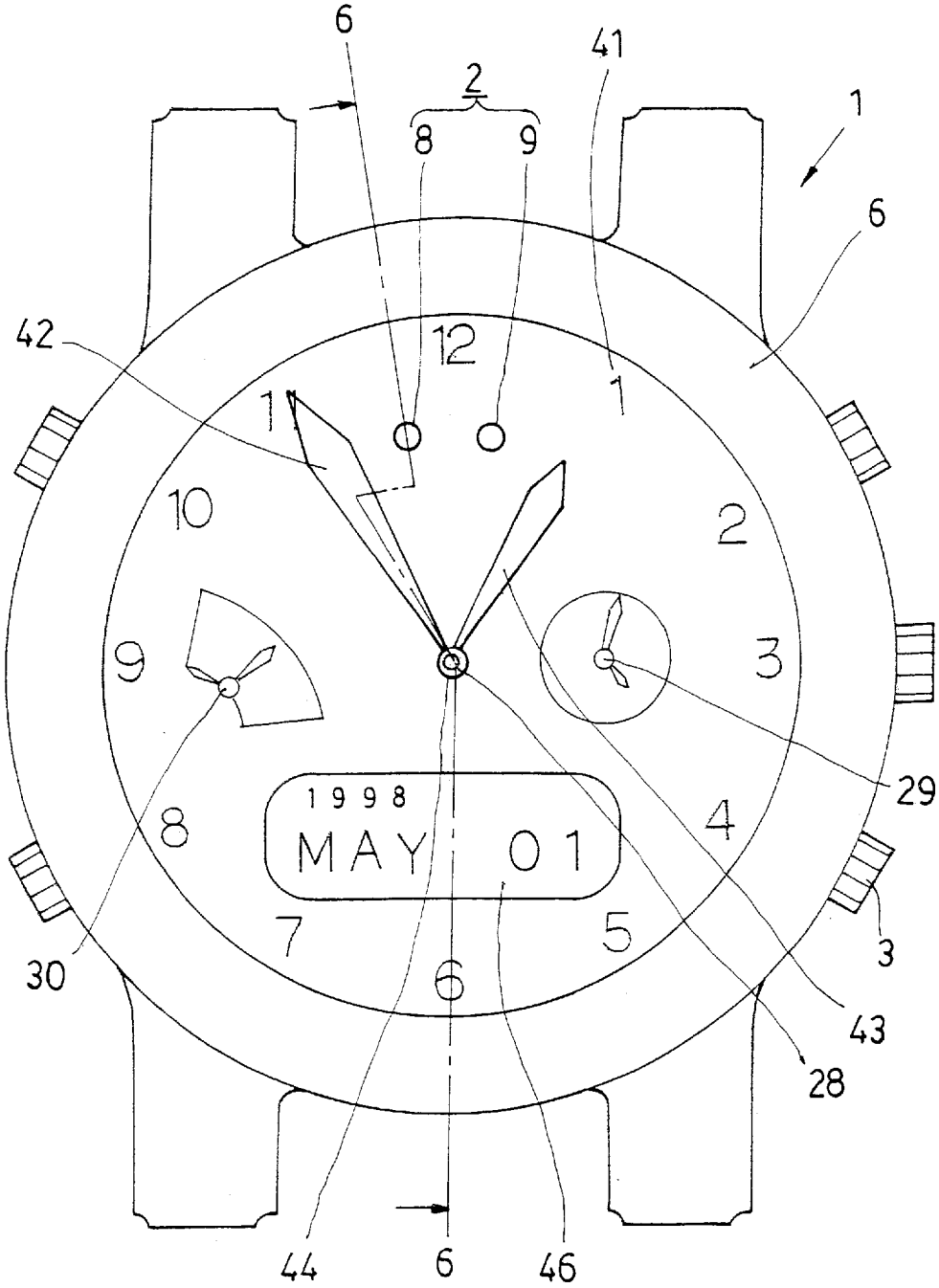
FIG. 4 is a schematic plan view of the timepiece, showing the external view thereof.
Figure 5:
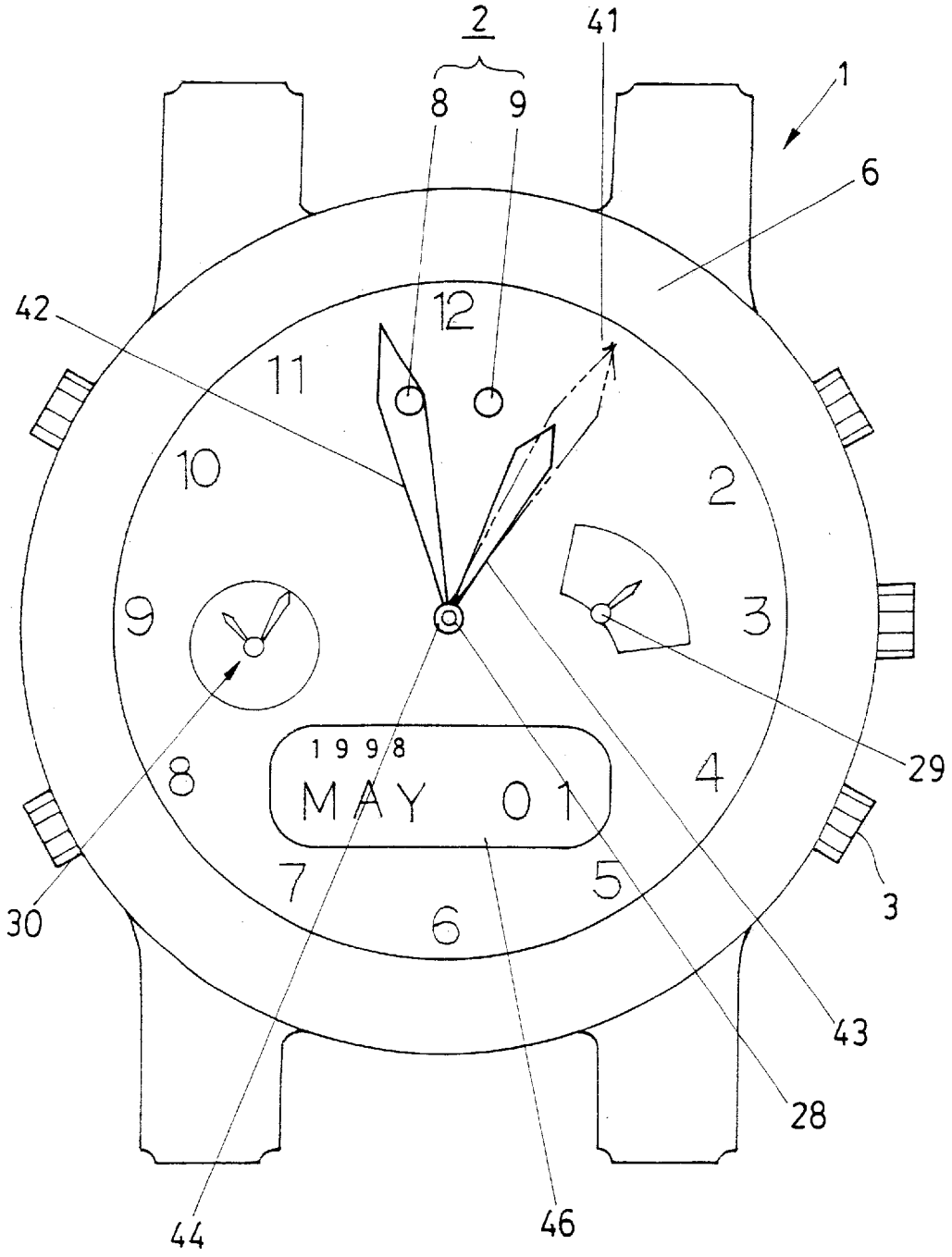
FIG. 5 is a schematic plan view of the timepiece, showing an operation for causing the minute hand thereof to withdraw from over a transmitting portion of optical communication means, and a state where functions of the timepiece are reassigned.
Figure 6:
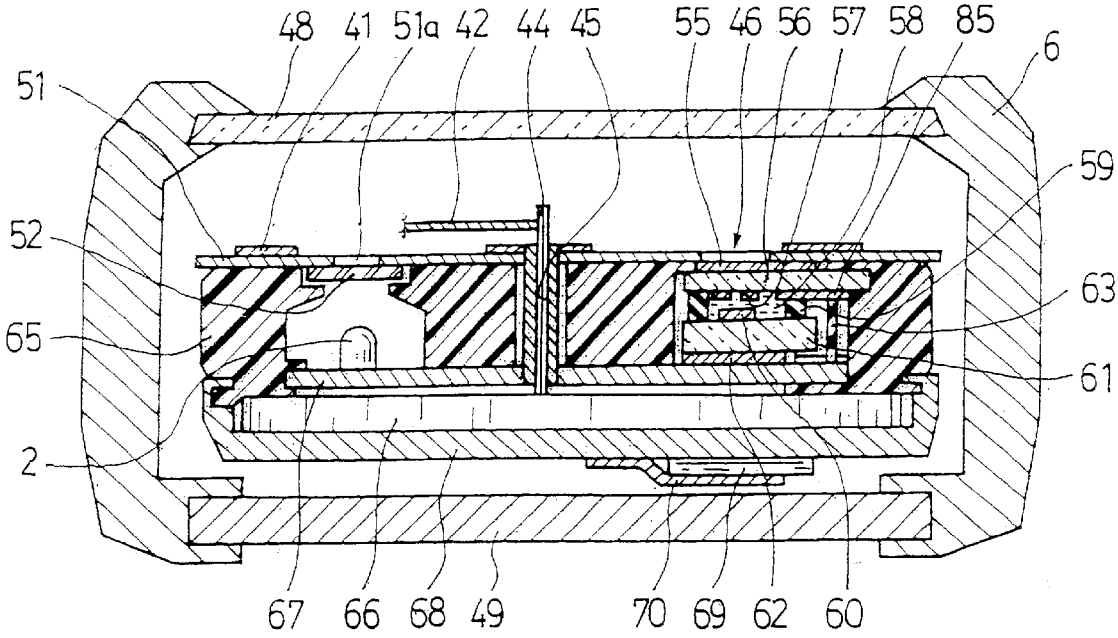
FIG. 6 is a schematic sectional view taken on line 6—6 of FIG. 4.

Now, with reference to FIGS. 4 to 6, the timepiece according to the first embodiment is described in further detail. FIGS. 4 and 5 are schematic plan views showing the external view of the timepiece, and FIG. 6 is a schematic sectional view taken on line 6—6 of FIG. 4.

First, the module structure of the timepiece 1 according to this embodiment is described hereinafter. The timepiece 1 according to this embodiment is a combination timepiece comprising both an analog display part having two hands, consisting of the minute hand 42 and the hour hand 43, and the hand shaft 44, and a digital display part for performing time display shown in numbers. The digital display part is provided with the liquid crystal display panel 46.

As shown in FIG. 6, the liquid crystal display panel 46 has a structure wherein a first substrate 56 made up of a glass substrate, disposed on the side of the glass 48 of the timepiece, and a second substrate 61, made up of a glass substrate, disposed so as to oppose the first substrate 56 with a sealing part 59 interposed therebetween, are installed across a predetermined spacing provided therebetween. Further, opposite electrodes 57 made up of an indium tin oxide (ITO) film which is a transparent and electrically conductive film are installed on top of the first substrate 56. Further, on top of the second substrate 61 as well, signal electrodes 60 made up of an ITO film are installed. Spots where the opposite electrodes 57 cross the signal electrodes 60, respectively, constitutes pixels, and display can be effected by applying a voltage to a liquid crystal layer 58.

The liquid crystal layer 58 containing liquid crystal and transparent solids is sealed in-between the first substrate 56 and the second substrate 61. With this embodiment, mixed liquid crystal PNM-157 (trade name) manufactured by Dainippon Ink and Chemicals, Inc. is utilized as raw material for the liquid crystal layer 58, and the liquid crystal layer 58 is formed by irradiation of ultraviolet rays having a wavelength at 360 nanometers (nm) or more at an intensity of 30 $mW/cm^2$ for 60 seconds after sealing in the mixed liquid crystal. The liquid crystal layer 58 exhibits a scattering characteristic when no voltage is applied thereto.

In the case of a voltage applied to the pixels being sufficiently low, the liquid crystal layer 58 exhibits the scattering characteristic due to use of the liquid crystal layer 58 described above, and becomes transparent as the voltage applied rises. Accordingly, display due to scattering and transparency can be effected by the agency of the liquid crystal layer 58 alone, thus enabling bright display to be realized.

On the upper side (on the glass 48 side) of the first substrate 56 composing the liquid crystal display panel 46, an ultraviolet ray cutout layer 55 is installed in order to prevent ultraviolet rays from being irradiated from an application environment of the timepiece 1 to the liquid crystal layer 58. On the underside of the second substrate 61, a reflector 62 is installed in order to render display of the liquid crystal display panel brighter. For the reflector 62, a thin aluminum film with a thin silver film formed thereon to which protective resin is further applied is used. In order to apply given signals to the pixels of the liquid crystal display panel, zebra rubber 63 and connection electrodes 85 are installed between the opposite electrodes 57 and a circuit part 67 for electrical connection therebetween.

Further, the timepiece module comprises a hand driving part 66, the hand driving part 66 comprises the hand shaft 44 penetrating a hand shaft through-hole 45, and the hand shaft 44 comprises two coaxial shafts having the minute hand 42 and the hour hand 43 attached to a tip thereof respectively and independently.

Furthermore, for displaying time by the hands and shielding the sealing part 59 of the liquid crystal display panel 46, a dial 51 is installed. The dial 51 comprises hour numerals 41 consisting of numbers from one to twelve, the hand shaft through-hole 45, a display opening for the liquid crystal display panel 46, and an opening 51*a* for the transmitting means 8 and the receiving means 9 of the optical communication means 2.

The optical communication means 2 provided with the transmitting means 8 and the receiving means 9 is installed on top of the circuit part 67, and an optical filter 52 for allowing light at a specific wavelength to transmit is installed between the optical communication means 2 and the opening 51*a* of the dial 51. For the transmitting means 8 of the optical communication means 2, an LED emitting red light is used, while for the receiving means 9, a phototransistor is used.

For prevention of optical noises caused by the application environment of the timepiece 1 during optical communication, a filter for selectively transmitting light at a wavelength of light emitted from the LED emitting red light is used for the optical filter 52.

Further, on the upper side of the hand driving part 66, a power source circuit, and the circuit part 67 comprising the CPU 10, the RAM 12, the ROM 11, the communication circuit block 14, the crystal oscillation circuit 18, and the crystal oscillator 17, as shown in FIG. 1, are disposed.

The liquid crystal display panel 46, the circuit part 67, the dial 51, and the optical communication means 2 are retained by an upper module retainer 65, while the hand driving part 66, and a battery 69 supported by a battery holder 70 are retained by a lower module retainer 68. The timepiece module is completed by the upper module retainer 65 and the lower module retainer 68.

The timepiece module is placed in an outer sheath made up of a case 6, the glass 48, and a case back 49.

The timepiece 1 is provided with the four operation switches 3 around the rim of the case 6. Each of the operation switches 3 can cause respective different interrupts to occur to the CPU 10.

With the timepiece module, the optical communication means 2 are disposed on the underside of the dial 51, and only the opening 51*a* which is small is provided in a portion of the dial 51, located at a position corresponding to the transmitting means 8 and the receiving means 9 of the optical communication means 2. Accordingly, the user of the timepiece 1 can hardly recognize the optical communication means 2. As a result, there no longer exist constraints imposed on designing of the timepiece 1 due to the installation of the optical communication means 2.

Further, as the optical communication means 2 has a thickness identical or thinner than that of the liquid crystal display panel 46, the same has little adverse effect on the thickness of the timepiece 1. In addition, it is possible to further reduce visibility of the optical communication means 2 by installing the optical filter 52 between the optical communication means 2 and the dial 51, and by adopting identical color tone for both the optical filter 52 and the dial 51 or adopting a color identical to that of the hour numerals 41 for the optical filter 52.

FIG. 5 shows a state of the timepiece 1 shown in FIG. 4 after subjected to communication with the external apparatus via the optical communication means 2, executing function processing on the basis of information acquired from the external apparatus, and thereby performing a predetermined processing by the agency of the display function means 38 shown in FIG. 3.

While the optical communication means 2 are in communication, rotation of the hand shaft 44 is stopped or in case that a hand (the minute hand 42 or the hour hand 43) is positioned over the transmitting means 8 or the receiving means 9 of the optical communication means 2 as shown in FIG. 5, the hand is rotatably shifted to a position so as to withdraw from over the transmitting means 8 or the receiving means 9 as shown by the phantom line in the figure.

Further, it is possible to clearly indicate by stopping the rotation of the hand shaft during communication that the optical communication means 2 are in use for communication.

In FIG. 4, the hand shaft block 28 (the hand shaft block A in FIG. 3) performs time display, the hand shaft block 29 (the hand shaft block B in FIG. 3) indicates month and day with a hand and a scale divided in a round shape, and the hand shaft block 30 (the hand shaft block C in FIG. 3) indicates day-of-week with a hand and a scale divided in a fan-like shape.

Subsequently, in FIG. 5, the hand shaft block 28 performs time display, the hand shaft block 29 displays the name of a country with a hand and a fan-shaped scale (in alphabet, and so forth), and the hand shaft block 30 indicates time in the country displayed by the hand shaft block 29.

Thus, with the timepiece 1 according to this embodiment, it is possible to render a plurality of displays variable, enabling a user-friendly display or a display optimum for application purposes to be effected.

Figure 7:
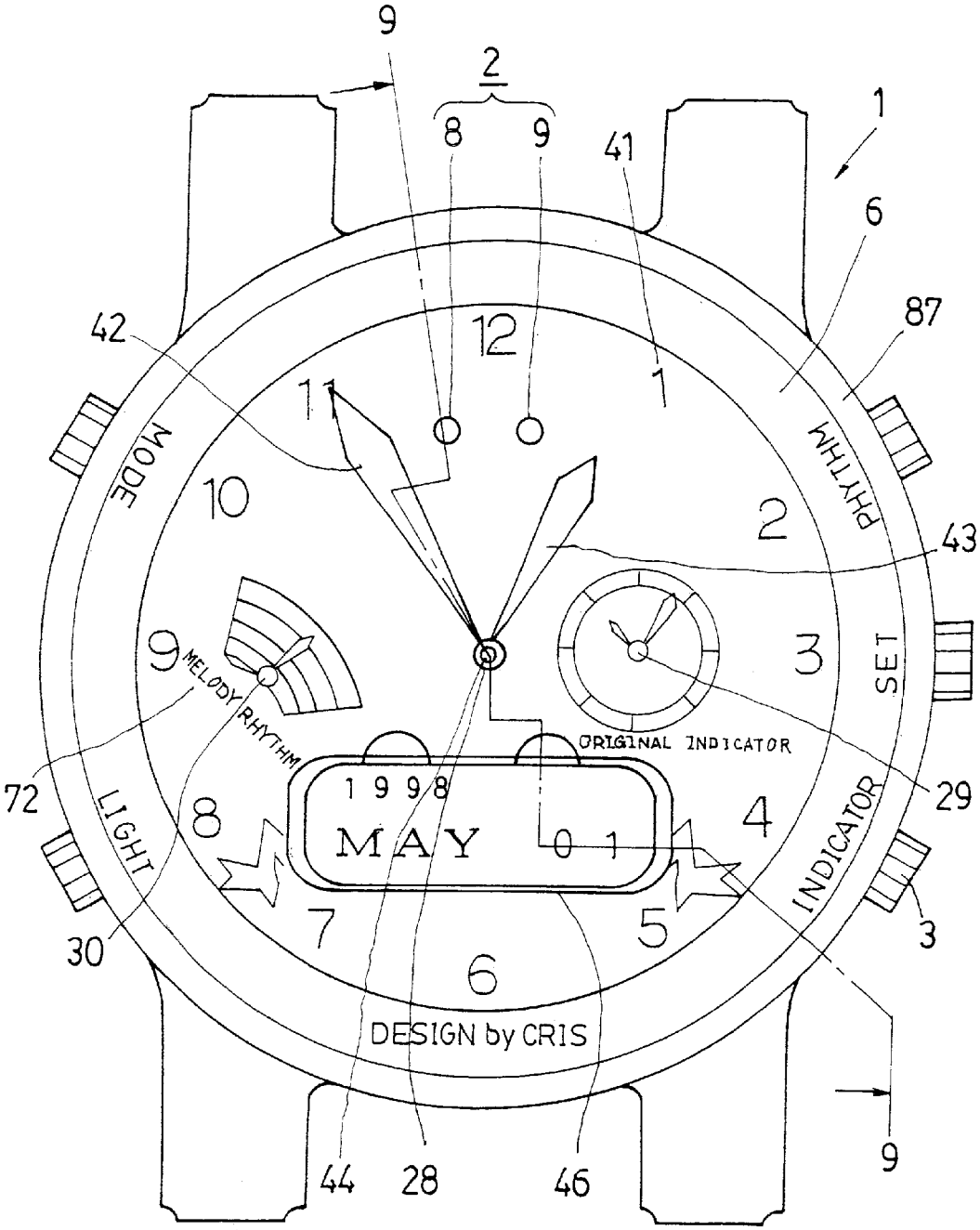
FIG. 7 is a schematic plan view of a timepiece comprising communication means and hand shaft control means according to a second embodiment of the invention.
Figure 8:
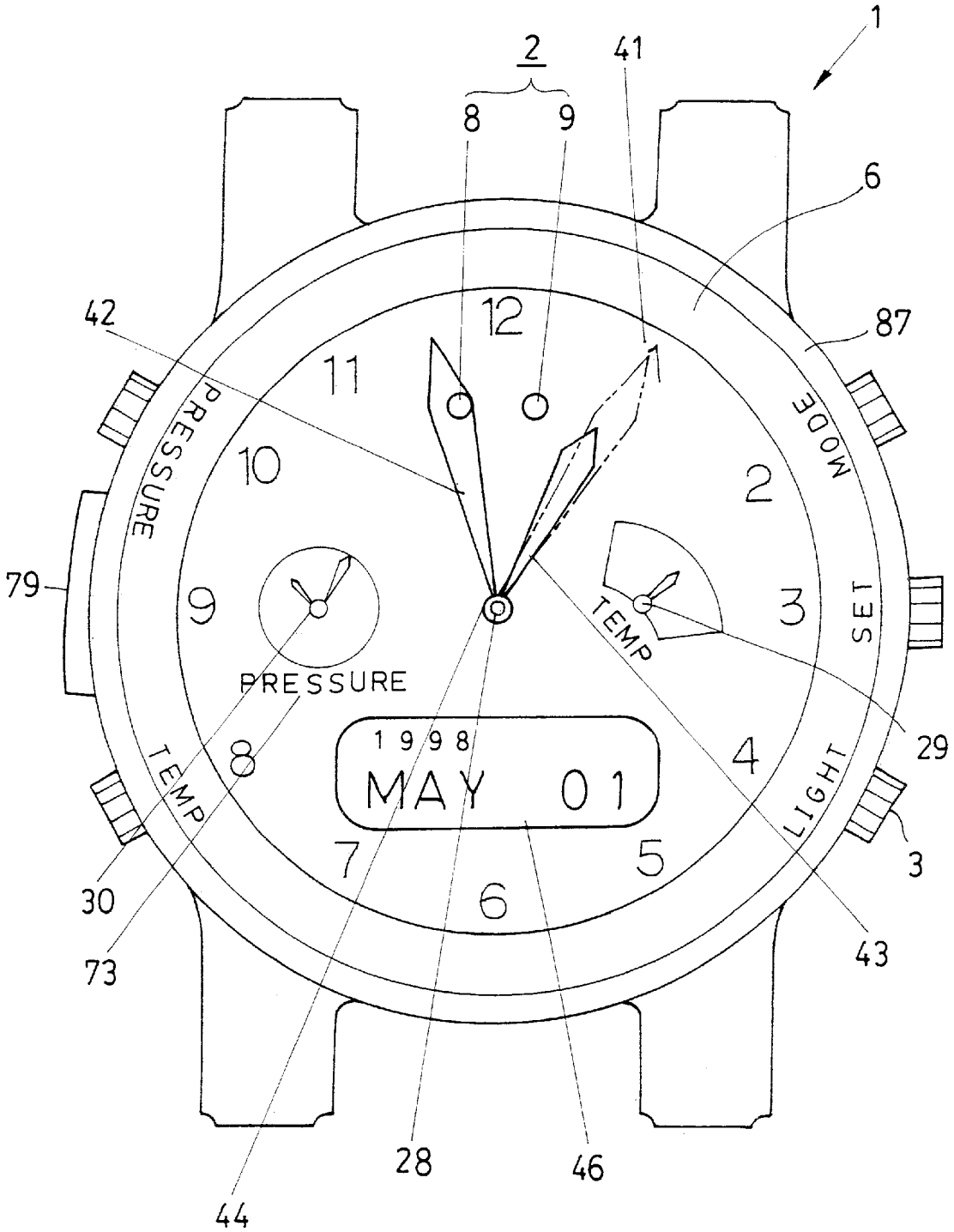
FIG. 8 is a schematic plan view of the timepiece, showing a state thereof after functions of the timepiece are reassigned.
Figure 9:
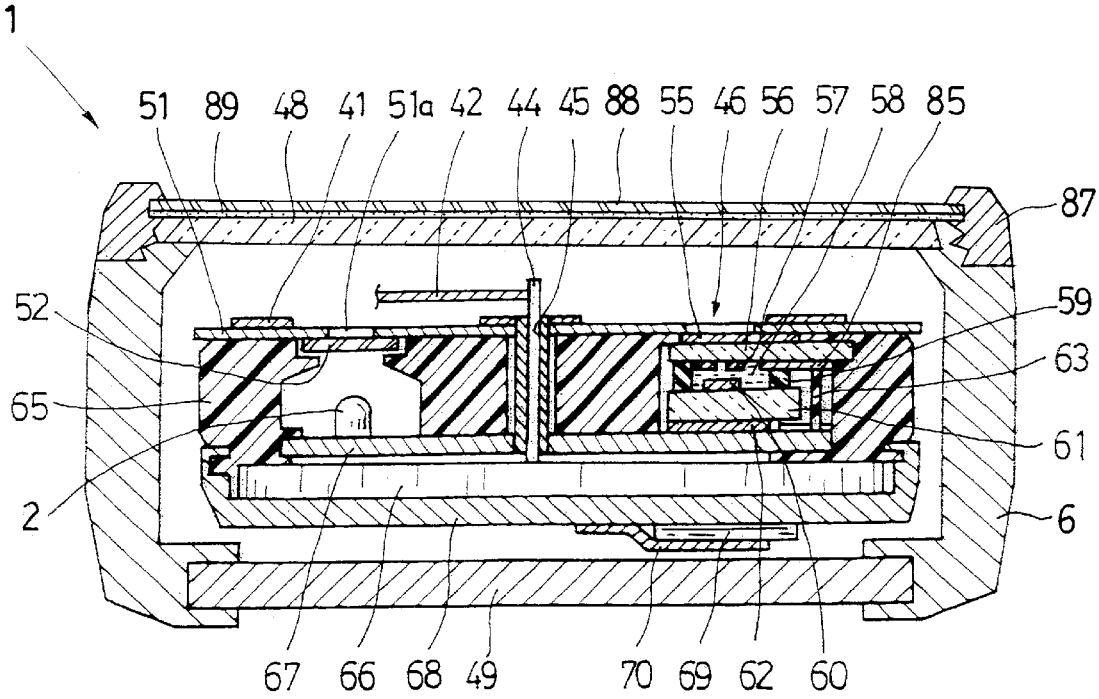
FIG. 9 is a schematic sectional view taken on line 9—9 of FIG. 7.

Second Embodiment: FIGS. 7 to 9

A timepiece according to a second embodiment of the invention is described hereinafter with reference to FIGS. 7 to 9. FIG. 7 is a schematic plan view showing the external view of the timepiece according to the second embodiment of the invention. FIG. 8 is a schematic plan view of the timepiece shown in FIG. 7, after changing hand shaft control and an exchange display part, and FIG. 9 is a schematic sectional view taken on line 9—9 of FIG. 7.

In these figures, parts corresponding to those in FIGS. 1 to 6, with reference to which the first embodiment of the invention is described, are denoted by like reference numerals.

First, the module structure of the timepiece 1 according to this embodiment is described hereinafter. The timepiece 1 according to this embodiment is a combination timepiece comprising both an analog display part having two hands consisting of a minute hand 42 and an hour hand 43, and a hand shaft 44, serving as a time display part, and a digital display part for displaying time in numbers. The digital display part is provided with a liquid crystal display panel 46.

As shown in FIG. 9, the liquid crystal display panel 46 has a structure wherein a first substrate 56 made up of a glass substrate, disposed on the side of the glass 48, and a second substrate 61, made up of a glass substrate, disposed so as to oppose the first substrate 56 with a sealing part 59 interposed therebetween are installed across a predetermined spacing provided therebetween. Further, opposite electrodes 57 made up of an indium tin oxide (ITO) film which is a transparent and electrically conductive film are provided on top of the first substrate 56. Further, on top of the second substrate 61 as well, signal electrodes 60 made up of an ITO film are provided. Spots where the opposite electrodes 57 cross the signal electrodes 60, respectively, constitutes respective pixels, and display can be effected by applying a voltage to a liquid crystal layer 58.

The liquid crystal layer 58 containing liquid crystal and transparent solids is sealed in between the first substrate 56 and the second substrate 61. With this embodiment, mixed liquid crystal PNM-157 (trade name) manufactured by Dainippon Ink and Chemicals, Inc. are utilized as raw material for the liquid crystal layer 58, and the liquid crystal layer 58 is formed by irradiation of ultraviolet rays having a wavelength at 360 nanometers (nm) or more at an intensity of 30 $mW/cm^2$ for 60 seconds after sealing in the mixed liquid crystal. The liquid crystal layer 58 exhibits a scattering characteristic when no voltage is applied thereto.

In the case of a voltage applied to the pixels being sufficiently low, the liquid crystal layer 58 exhibits the scattering characteristic due to use of the liquid crystal layer 58 described above, and becomes transparent as the voltage applied rises. Accordingly, display due to scattering and transparency can be effected by the agency of the liquid crystal layer 58 alone, thus enabling bright display to be realized.

On the upper side (on the glass 48 side) of the first substrate 56 composing the liquid crystal display panel 46, an ultraviolet ray cutout layer 55 is installed in order to prevent ultraviolet rays from being irradiated from an application environment of the timepiece 1 to the liquid crystal layer 58. On the underside of the second substrate 61, a reflector 62 is installed in order to render display of the liquid crystal display panel brighter. For the reflector 62, a thin aluminum film with a thin silver film formed thereon to which protective resin is further applied is used. In order to apply given signals to the pixels of the liquid crystal display panel, zebra rubber 63 and connection electrodes 85 are installed between the opposite electrodes 57 and a circuit part 67 for electrical connection therebetween.

Further, the timepiece module comprises a hand driving part 66, the hand driving part 66 comprises the hand shaft 44 penetrating a hand shaft through-hole 45, and the hand shaft 44 comprises two coaxial shafts having the minute hand 42 and the hour hand 43 attached to a tip thereof respectively and independently.

Furthermore, for displaying time by the hands and shielding the sealing part 59 of the liquid crystal display panel 46, a dial 51 is installed. The dial 51 comprises hour numerals 41 consisting of numbers from one to twelve, the hand shaft through-hole 45, a display opening of the liquid crystal display panel 46, and an opening 51*a* for the transmitting means 8 and the receiving means 9 of the optical communication means 2.

The optical communication means 2 provided with the transmitting means 8 and the receiving means 9 is installed on top of the circuit part 67, and an optical filter 52 for allowing light at a specific wavelength to transmit is installed between the optical communication means 2 and the opening 51*a* of the dial 51. For the transmitting means 8 of the optical communication means 2, an LED emitting red light is used while for the receiving means 9, a phototransistor is used.

For prevention of optical noises caused by the application environment of the timepiece 1 during optical communication, a filter for selectively transmitting light at a wavelength of light emitted from the LED emitting red light is used for the optical filter 52.

Further, on the upper side of the hand driving part 66, a power source circuit, and the circuit part 67 comprising a CPU 10, a RAM 12, a ROM 11, a communication circuit block 14, a crystal oscillation circuit 18, and the crystal oscillator 17, as shown in FIG. 1, are disposed.

The liquid crystal display panel 46, the circuit part 67, the dial 51, and the optical communication means 2 are retained by an upper module retainer 65 while the hand driving part 66, and a battery 69 supported by a battery holder 70 are retained by a lower module retainer 68. The timepiece module is completed by the upper module retainer 65 and the lower module retainer 68.

The timepiece module is placed in an outer sheath made up of a timepiece case 6, a glass 48, and a case back 49.

The timepiece 1 is provided with five operation switches 3 around the rim of the case 6. Each of the operation switches 3 can cause respective different interrupts to occur to the CPU.

With the timepiece module, the optical communication means 2 are disposed on underside of the dial 51, and only the opening 51*a* which is small is provided in a portion of the dial 51, located at a position corresponding to the transmitting means 8 and the receiving means 9 of the optical communication means 2. Accordingly, a user of the timepiece 1 can hardly recognize the optical communication means 2. As a result, there no longer exists constraints imposed on designing of the timepiece 1 due to the installation of the optical communication means 2.

Further, as the optical communication means 2 has a thickness identical to or thinner than that of the liquid crystal display panel 46, the same has little adverse effect on the thickness of the timepiece 1. In addition, it is possible to further reduce visibility of the optical communication means 2 by installing the optical filter 52 between the optical communication means 2 and the dial 51, and by adopting identical color tone for both the optical filter 52 and the dial 51 or adopting a color for the optical filter 52 identical to that of the hour numerals 41.

FIG. 8 shows a state of the timepiece 1 shown in FIG. 7 after function processing is executed thereon by the agency of the optical communication means 2, function selection means, and hand shaft control means. While the optical communication means 2 are in communicating state, rotation of the hand shaft 44 is stopped, or in case that a hand (the minute hand 42 or the hour hand 43) is positioned over the transmitting means 8 or the receiving means 9 of the optical communication means 2 like the minute hand 42 shown by a solid line in FIG. 8, the hand is rotatably shifted to a position so as to withdraw from over the optical communication means 2 as shown by the phantom line in the figure.

In FIG. 7, a hand shaft block 28(A) performs time display, a hand shaft block 29(B) indicates contents (ORIGINAL INDICATOR) set by the user of the timepiece 1 with a hand, and a hand shaft block 30(C) indicates a melody rhythm with a fan-shaped display. The hand shaft block 29(B) indicates melody numbers.

Further, as shown in FIGS. 7 and 9, an exchange display part 88 formed by pasting a printed layer 89 to the rear face of a transparent plastic substrate is fixedly attached to the surface of the glass 48 by a retainer ring 87 for fixing the exchange display part 88 to the timepiece case 6 with screws. As shown in FIG. 7, there are provided the printed layer 89 printed with notations of "MODE", "LIGHT", "INDICATOR", "SET" and "RHYTHM" at positions corresponding to the respective operation switches 3, character display around the display of the liquid crystal display panel, display of a circle and a notation "ORIGINAL INDICATOR" around the hand shaft block 29, and a notation "MELODY RHYTHM" in a melody notation part 72 around the hand shaft block 30. Also, a notation giving the name (provisional) of the user, "DESIGN by CRIS", is also provided.

In FIG. 8, an assignment of the respective operation switches 3 shown in FIG. 7 is changed. Notations, "MODE", "SET" and "LIGHT", are disposed on the right hand side in the figure while notations, "PRESSURE" (atmosphere pressure) and "TEMP" (ambient temperature), outputted by a sensor of the timepiece 1, are disposed on the left hand side in the figure. The character display around the display of the liquid crystal display panel is eliminated, thereby rendering display simpler. Further, there are provided a notation "TEMP" around the hand shaft block 29(B), and a notation "PRESSURE" around the hand shaft block 30(C), serving as a pressure display part 73.

The liquid crystal display panel 46 performs display of, for example, year, date, time, chronograph, memo, schedule, alarm, timer, temperature, atmospheric pressure, weather forecast, and so forth.

As described in the foregoing, it becomes possible to cause the timepiece 1 to execute a variety of function selections on the basis of information from the external apparatus by the agency of the communication means and the hand shaft control means, so that the movement of the motor driver for the respective hand shaft blocks, as represented by the movement of the hand shaft 44, can be selected. Accordingly, the movement of respective hand shafts, suited to the purpose of the user of the timepiece 1, is enabled. Further, as it is also possible to change an assignment of the respective hand shaft, the timepiece can be used effectively.

Further, a method of giving the notations by use of the printed layer 89 in the exchange display part 88 is adopted in order to display the contents of functions on the timepiece in the case of executing a change in function assignment to the respective hand shaft blocks. Further, since a method of fixedly attaching the exchange display part 88 to the timepiece with the retainer ring 87 is adopted, the exchange display part 88 can be retained on the glass 48. For providing the exchange display part 88 with strength, and preventing formation of interference fringes due to an air layer in a gap between the exchange display part 88 and the glass 48, a method of bonding the exchange display part 88 to the glass 48 with an adhesive layer is effective. The exchange display part 88 described above can be freely written on by printing on the transparent plastic substrate or a transparent sheet with the use of a printer.

Further, as a printed face is susceptible to scratches, if an ink layer face is provided on the side of the glass 48, this will enhance the durability of the printed face. Further, since the invention is characterized in that the printed face is shown in reverse, editing on the monitor 22 is performed with the exchange display part 88 in a state as mounted in the timepiece 1 in the case of preparing the exchange display part 88 with the use of the external apparatus 20, and printing is performed by flipping data from side to side or from top to bottom when transferring the data from the external apparatus 20 to the printer. With this embodiment, the plastic substrate is in use, however, a glass substrate may be used instead. Further, a cover glass (not shown) may be installed on top of the plastic substrate.

Thus, by utilizing the timepiece comprising the communication means and the hand shaft control means, and the external apparatus, it becomes possible to render a design variable by the agency of the exchange display part, thereby enabling expression of the timepiece to be diversified.

Third Embodiment: FIGS. 1 to 3, and FIG. 10

Figure 10:
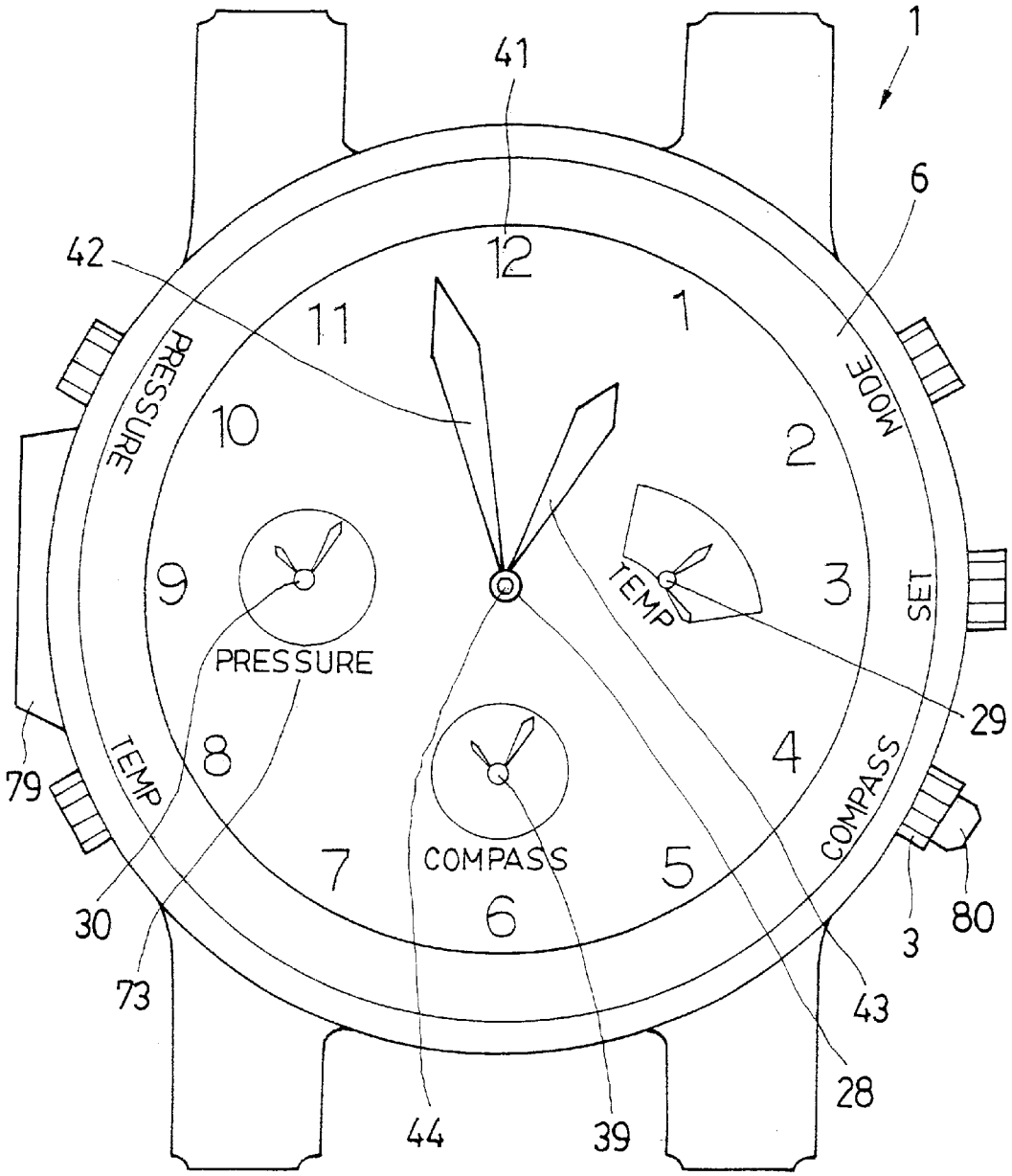
FIG. 10 is a schematic plan view of a timepiece comprising communication means and hand shaft control means according to a third embodiment of the invention.

Subsequently, a third embodiment of the invention is described with reference to FIGS. 1 to 3, and FIG. 10. FIG. 10 is a schematic plan view showing the external view of the timepiece according to the third embodiment of the invention. In FIG. 10, parts corresponding to those in FIGS. 1 to 6, with reference to which the first embodiment of the invention is described, are denoted by like reference numerals.

The timepiece according to the third embodiment of the invention is characterized in that it is a timepiece capable of effecting analog display only, expressing a variety of information contents by hands, and comprises wired communication means as part of communication means.

First, the module structure of the timepiece 1 according to this embodiment is described. The timepiece 1 according to the third embodiment is a timepiece comprising an analog display part having two hands consisting of the minute hand 42 and the hour hand 43, serving as a time display part. Further, hand shafts are of a four-motor type comprising a hand shaft block 28(A), a hand shaft block 29(B), a hand shaft block 30(C) and a hand shaft block 39(D).

Further, a timepiece module comprises a hand driving part (not shown), the hand driving part comprises a hand shaft 44 penetrating a hand shaft through-hole 45, and the hand shaft 44 is provided with the minute hand 42 and the hour hand 43 attached thereto independently. Further, a dial 51 comprises hour numerals 41 consisting of numbers from one to twelve, and the hand shaft through-hole. The dial 51 has transmissiveness, and makes it possible to generate power by irradiation of light to a solar cell, which is a photovoltaic device (not shown), installed on the underside of the dial 51. Electric power generated by the solar cell is accumulated in a battery (secondary battery) in the form of electric energy.

Further, on the underside of the hand driving part, a power source circuit, and a circuit part (not shown) comprising a CPU 10, a RAM 12, a ROM 11, a communication circuit block 14, a crystal oscillation circuit 18, and a crystal oscillator 17, are provided. The battery is in contact with the circuit part, and is retained by a battery holder.

The hand driving part, the dial, and the photovoltaic device are retained by an upper module retainer (not shown) while the circuit part and the battery are retained by a lower module retainer (not shown). Further, the timepiece module is completed by the upper module retainer and the lower module retainer. The timepiece module is placed in a timepiece case 6, a glass 48, and a case back 49.

The timepiece 1 is provided with a plurality of operation switches 3. Each of the operation switches 3 can cause a different interrupt to occur. Further, one of the operation switches 3 is provided with a connection terminal 80 for performing serial communication by a wired system. The connection terminal 80 is a serial connection terminal for performing connection with an external apparatus 20, enabling signals to be transmitted to, and received from communication means.

In FIG. 10, an assignment of the respective operation switches 3 is shown such that notations, "MODE", "COMPASS" and "SET", are disposed on the right hand side in the figure while notations, "PRESSURE" (atmospheric pressure) and "TEMP" (ambient temperature) which are output of a sensor of the timepiece are disposed on the left hand side in the figure. Further, a notation "TEMP" is provided around the hand shaft block 29(B), a notation "PRESSURE" is provided around the hand shaft block 30(C), and a notation "COMPASS" indicating bearings is provided around the hand shaft block 39(D).

"COMPASS" not only shows bearings but also is capable of displaying the direction of a destination, the direction of a departing point, distance, expected time of arrival, an average speed, and so forth by the agency of data retained by an address information table 35 in the RAM 12 beforehand via the communication means, and bearings, or by the agency of GPS (a global positioning system) which recognizes location information by receiving radio waves. Sensor means 79 comprising a direction sensor or an antenna for GPS is provided in such a way as to jut out from the sidewall of the timepiece 1. In the case of transferring massive data such as location information, wired communication is performed, paying particular attention to minimize depletion of the battery of the timepiece 1. Further, sensors 79 for measuring ambient temperature and pressure, respectively, are installed on the side face of the timepiece case 6, and display of such measured information is assigned to the respective hand shaft blocks by hand shaft control means.

Thus, by sending or receiving information from the external apparatus to the timepiece comprising the communication means and the hand shaft control means, it becomes possible to assign a method of displaying information to the respective hand shaft blocks, and also to change assignment, thereby enabling information contents suited to purposes to be expressed by the respective hand shafts, and a direction and rough information (read by the angle) can be expressed by the movement of the respective hand shafts, which is effective.

Further, as with this embodiment, the adoption of time display in one form is effective in terms of achieving lower power consumption, flatness in profile, and function simplification in comparison with a case of employing a liquid crystal display panel for performing time display.

Furthermore, as the connection terminal 80 is adapted for the wired system, it becomes possible to provide the timepiece 1 with the battery (secondary battery), and to charge the battery via a charging circuit (not shown). That is, a method whereby electrical energy is transmitted from the external apparatus to the timepiece is adopted. With the timepiece 1, charging is implemented while the timepiece 1 is in communication with the external apparatus by executing sending and receiving of signals, and transmission of electrical energy, on a timesharing basis, thereby relieving a user of the timepiece 1 from inconvenience of charging the battery. That is, with this embodiment, a system of combining two types of charging, namely, charging during communication (transmission of electrical energy) and charging while the timepiece 1 is used for time display is adopted.

Furthermore, since the timepiece according to the third embodiment is provided with the four hand shaft blocks, battery consumption reduction means for stopping operation of the hand shaft blocks other than the hand shaft block 28(A) depending on the amount of electrical energy that remains in the battery is provided. Further, as a method of reducing consumption of energy in the battery, it is effective to operate only the hand shaft blocks with a light-weight hand. For example, it will be effective to stop operation of the hand shaft blocks other than the hand shaft block 30.

Figure 11:
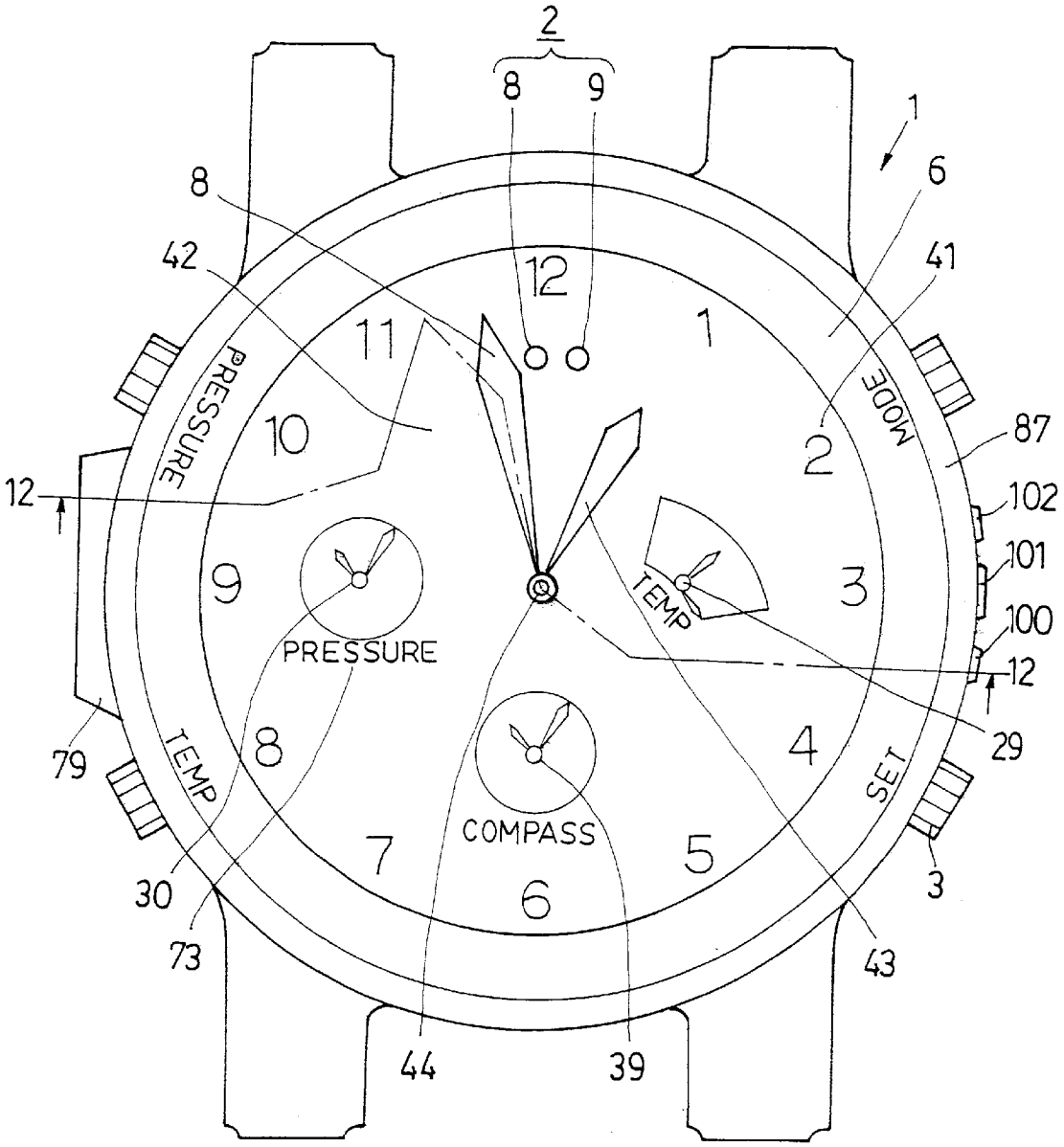
FIG. 11 is a schematic plan view of a timepiece comprising communication means and hand shaft control means according to a fourth embodiment of the invention.
Figure 12:
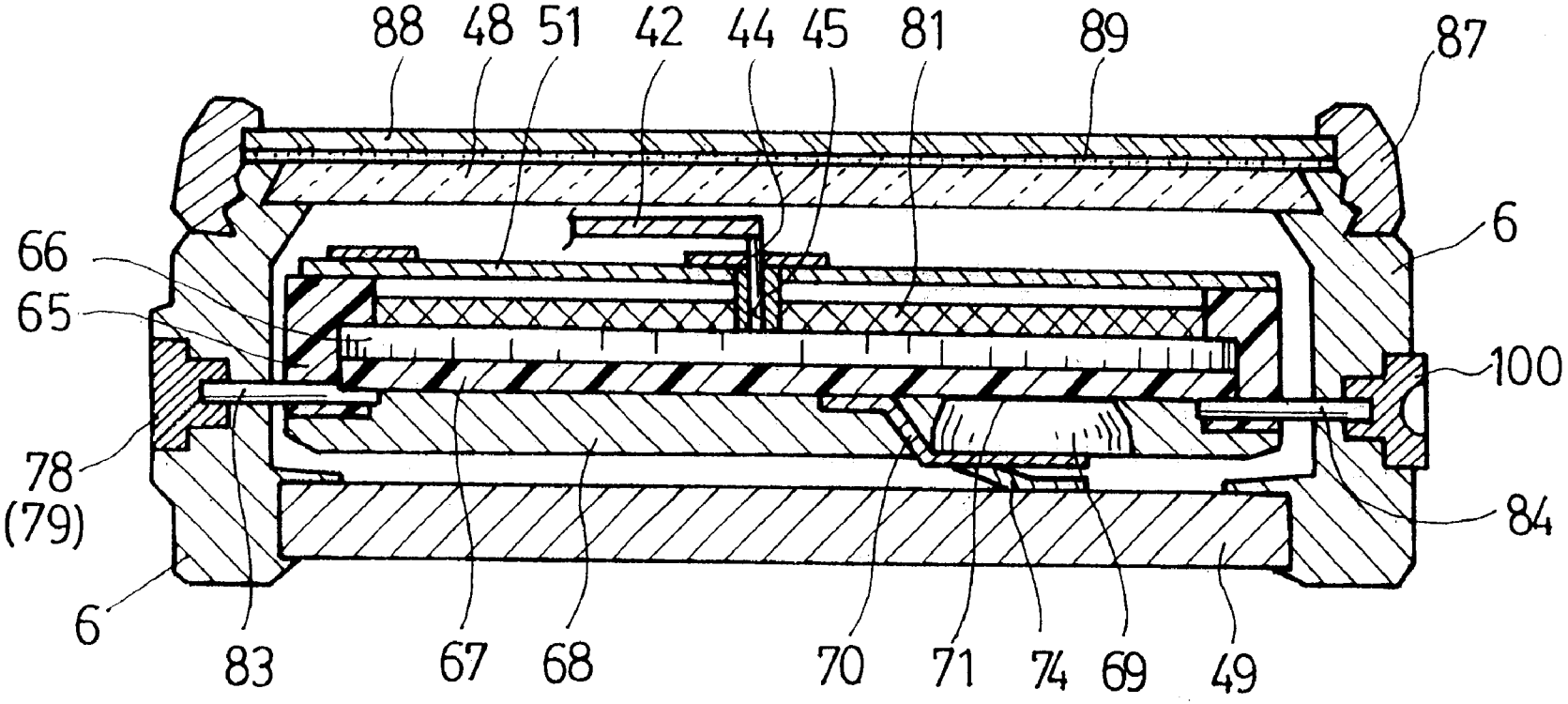
FIG. 12 is a schematic sectional view taken on line 12—12 of FIG. 11.
Figure 13:
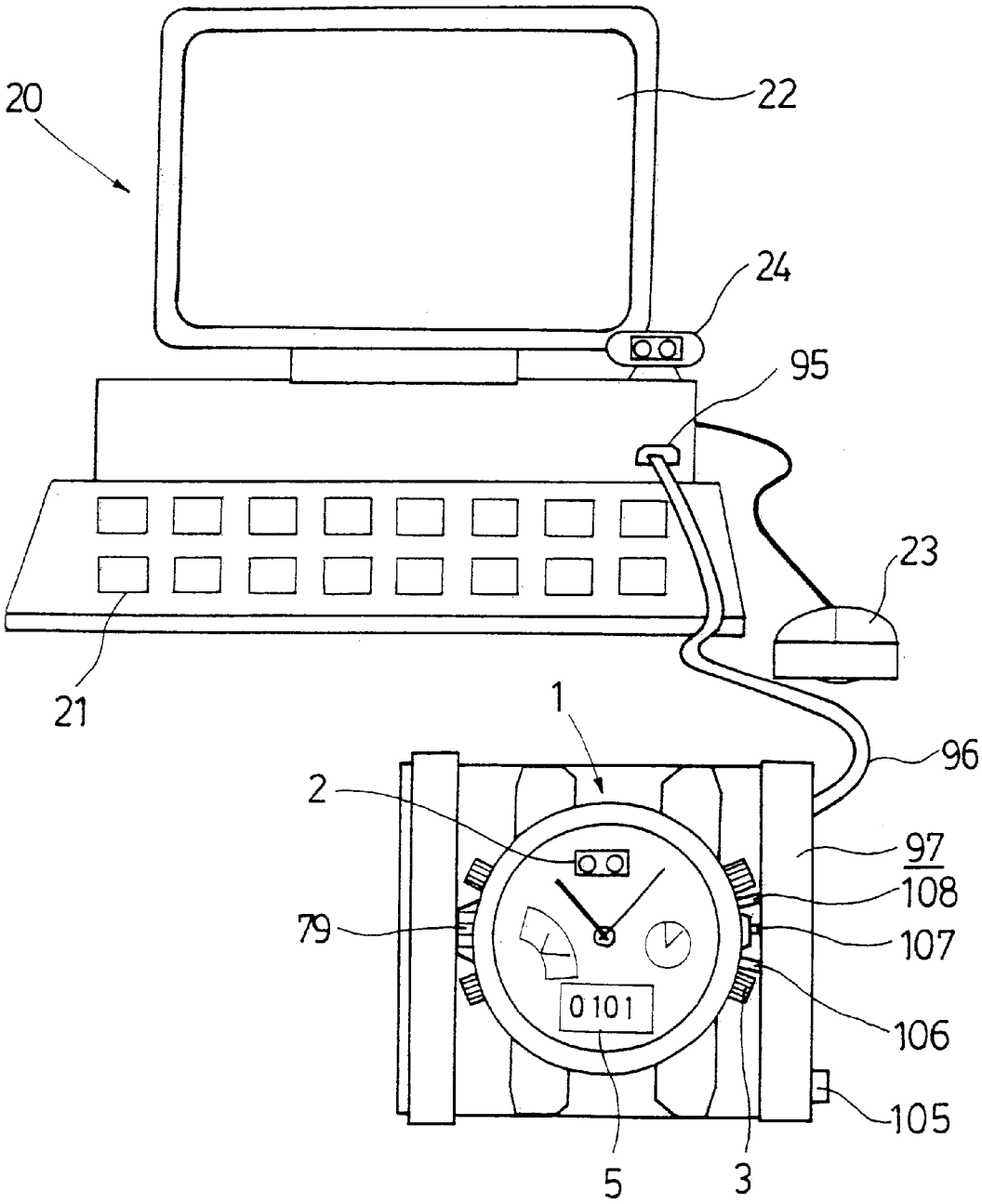
FIG. 13 is a schematic illustration showing a state of charging during wired communication between the timepiece and an external apparatus.

Fourth Embodiment: FIGS. 11, 12 and 13

Subsequently, a fourth embodiment of the invention is described with reference to FIGS. 11 and 12.

The fourth embodiment of the invention is characterized in that it is an analog timepiece for expressing a variety of information contents by hands, and comprises a sensor for measuring environmental information, wired communication means, and a terminal for charging a battery, disposed on the side of the timepiece opposite from the sensor.

FIG. 11 is a schematic plan view showing the external view of the fourth embodiment of the timepiece according to the invention, and FIG. 12 is a schematic sectional view taken on line 12—12 of FIG. 11.

First, the module structure of the timepiece 1 according to this embodiment is described. The timepiece 1 is a timepiece comprising an analog display part having two hands consisting of the minute hand 42 and the hour hand 43, serving as a time display part. Further, hand shafts are of a four-motor type comprising a hand shaft block 28, a hand shaft block 29, a hand shaft block 30, and a hand shaft block 39.

Further, as shown in FIG. 12, a timepiece module according to this embodiment comprises a hand driving part 66, the hand driving part 66 comprises a hand shaft 44 penetrating a hand shaft through-hole 45, and the hand shaft 44 is provided with the minute hand 42 and the hour hand 43 attached thereto independently. Further, a dial 51 comprises hour numerals 41 consisting of numbers from one to twelve, and the hand shaft through-hole 45. The dial 51 has transmissiveness, and makes it possible to generate power by irradiation of light to a solar cell, which is a photovoltaic device 81, installed on underside of the dial 51. Electric power generated by the photovoltaic device 81 is accumulated in a battery (secondary battery) in the form of electric energy.

Further, on the underside of the hand driving part 66, a power source circuit, and a circuit part 67 comprising a CPU, a RAM, a ROM, a communication circuit block, a crystal oscillation circuit, and a crystal oscillator are provided. The battery is in contact with the circuit part 67 via a battery electrode 71, and is retained by a battery holder 70. The battery holder 70 is electrically continuous with the positive (+) terminal of the battery, and also with a case back 49 via a case back contact electrode 74. As a result, a timepiece case 6 and the case back 49 are at a positive potential of the battery 69.

The hand driving part 66, the dial 51, and the photovoltaic device 81 are retained by an upper module retainer 65 while the circuit part 67, and the battery 69 are retained by a lower module retainer 68. Further, the timepiece module is completed by the upper module retainer 65 and the lower module retainer 68. The timepiece module is placed in an outer sheath made up of the timepiece case 6, a glass 48, and the case back 49.

The timepiece 1 is provided with a plurality of operation switches 3. Each of the operation switches 3 can cause a different interrupt to occur to the CPU. The timepiece 1 is further provided with a plurality of sensors 79 for measuring environmental conditions, comprising, for example, a pressure sensor 78, which is retained in the timepiece case 6 with airtightness thereof maintained. The pressure sensor 78 is connected with the circuit part 67 via a sensor wiring 83. Further, a temperature sensor (not shown) employing a thermistor is mounted in the circuit part 67, and a geomagnetic sensor as a compass is also mounted in the circuit part 67.

Further, the timepiece case 6 is provided with a data transfer terminal 102 for performing wired communication with an external apparatus, a ground terminal 100 for matching the potential thereof with that of the external apparatus, and a charging terminal 101 used for charging the battery 69 of the timepiece 1.

The respective terminals 100, 101 and 102 are connected with the circuit part 67 via a flexible printed board. Representing these terminals, the ground terminal 100 and a wiring 84 for ground potential are shown in FIG. 12.

In FIG. 11, an assignment of the respective operation switches 3 is shown such that notations, "MODE" and "SET", are disposed on the right hand side in the figure while notations, "PRESSURE" (atmospheric pressure) and "TEMP" (ambient temperature) which are output of the sensors 79 of the timepiece, are disposed on the left hand side in the figure. Further, a notation "TEMP" is provided around the hand shaft block 29, a notation "PRESSURE" is provided around the hand shaft block 30(C), and a notation "COMPASS" indicating bearings is provided around the hand shaft block 39(D).

"COMPASS" not only shows bearings but also is capable of displaying the direction of a destination, the direction of a departing point, distance, expected time of arrival, an average speed, and so forth by the agency of data retained by an address information table 35 in the RAM (not shown) beforehand via the communication means, and bearings, or by the agency of GPS (a global positioning system) which recognizes location information by receiving radio waves.

The sensors 79 comprising a directional sensor or an antenna for the GPS is provided in such a way as to jut out from the sidewall of the timepiece 1. In the case of transferring massive data such as location information, and so forth, wired communication is performed, enabling charging of the battery 69 from the external apparatus. Further, display of measured information acquired by the sensors 79 is assigned to the respective hand shaft blocks by hand shaft control means.

Thus, by sending or receiving information from the external apparatus to the timepiece comprising the communication means and the hand shaft control means, it becomes possible to assign a method of displaying information to the respective hand shaft blocks, and also to change the assignment, thereby enabling information contents suited to purposes to be expressed by the respective hand shafts, and a direction and rough information (read by the angle) can be expressed by the movement of the respective hand shafts, which is effective. Further, as with this embodiment, the adoption of time display in one form is effective in terms of achieving lower power consumption, flatness in profile, and function simplification in comparison with a case of employing a liquid crystal display panel for performing time display.

Furthermore, since this embodiment is provided with wired communication means, it becomes possible to charge the battery (secondary battery) installed in the timepiece 1 via a charging circuit (not shown). That is, a method whereby electrical energy is transmitted from the external apparatus to the timepiece 1 is adopted.

Charging can be implemented by placing the timepiece and the external apparatus, while the timepiece 1 is in communication with the external apparatus, thereby relieving a user of the timepiece 1 from inconvenience of charging the battery. That is, with this embodiment, it is possible to make use of two types of charging in combination, namely, charging during wired communication, and charging (by power generation at a photovoltaic part) while the timepiece 1 is in use for time display.

Further, the timepiece according to the fourth embodiment is provided with four hand shaft blocks, and battery consumption reduction means for stopping in stages the function of the respective hand shaft blocks or stopping operation of the hand shaft blocks other than the hand shaft block 28 depending on the amount of electrical energy that remains in the battery.

Furthermore, as a method of reducing consumption of energy in the battery, it is effective to operate only the hand shaft blocks with a light-weight hand. For example, it will be effective to stop operation of the hand shaft blocks other than the hand shaft block 30. Such setting can be executed by setting a condition from a stop-set menu of the external apparatus, sending the data to the timepiece, and storing the data in an internal memory of the timepiece.

Subsequently, a state of wired communication between the external apparatus 20 and the timepiece 1, and charging of the battery, according to the fourth embodiment, are described with reference to FIG. 13. FIG. 13 is a schematic illustration showing a state of the wired communication and charging of the battery being performed between the external apparatus 20 and the timepiece 1 via an interface unit 97.

The external apparatus 20 is a personal computer, and comprises input means 21 made up of a keyboard, a monitor 22, a mouse (pointing device) 23, a communication adapter 24 as an input/output device for optical signals, and a USB interface 95. With this embodiment, since exchange of data and the charging of the battery are performed via a cable, only the USB interface 95 is in use.

The USB interface 95 of the external apparatus 20 is connected with the USB interface unit 97 via a USB cable 96. The USB interface unit 97 is provided with a ground electrode 106 connected with the ground terminal 100 of the timepiece 1, a charging electrode 107 connected with the charging terminal 101, and a data transfer electrode 108 connected with the data transfer terminal 102. In order to render the respective terminals 100, 101 and 102 electrically continuous with the respective electrodes 106, 107 and 108 of the USB interface unit 97, a method is adopted whereby both sides of the timepiece 1 are clamped by the USB interface unit 97.

Thus, with this embodiment, not only exchange of information between the external apparatus 20 and the timepiece 1 is possible but also the charging can be executed. For the charging, electrical energy transmitted from the USB interface 95 of the external apparatus 20 is utilized. Also, actuation and stoppage of the charging can be controlled by turning a charging switch 105 on and off, respectively.

Figure 14:
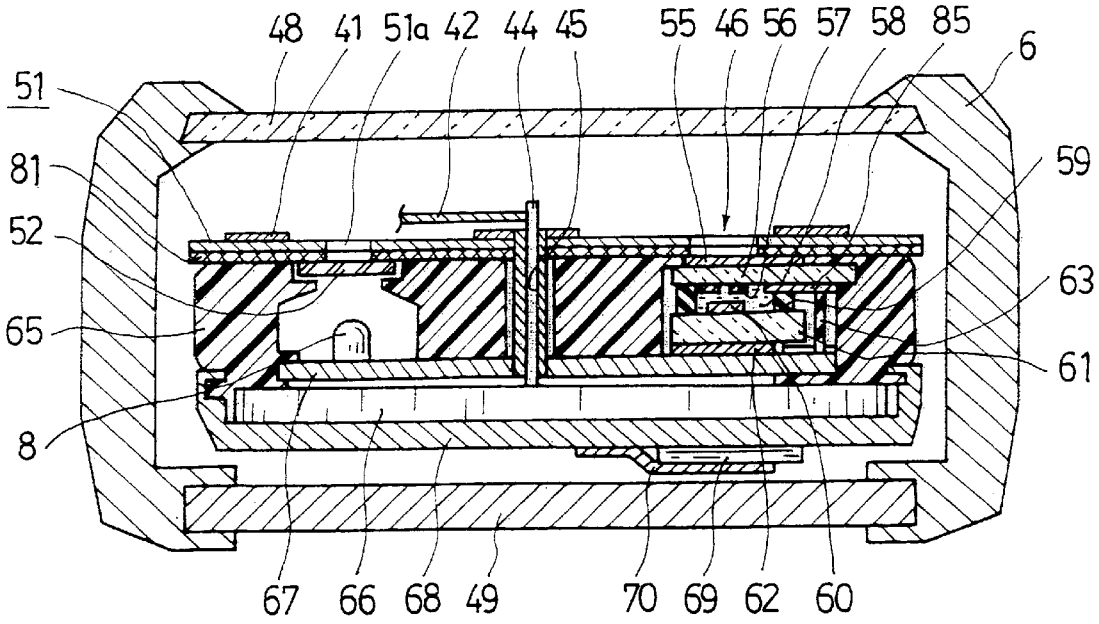
FIG. 14 is a schematic sectional view, similar to FIG. 9, of a timepiece comprising communication means and hand shaft control means according to a fifth embodiment of the invention.

Fifth Embodiment: FIG. 14

Subsequently, a timepiece according to a fifth embodiment of the invention is described hereinafter with reference to FIG. 14. FIG. 14 is a schematic sectional view of the timepiece, similar to FIG. 9. In FIG. 14, parts corresponding to those in FIG. 9 are denoted by like reference numerals, and description thereof is omitted.

The timepiece according to this embodiment differs from the timepiece shown in FIG. 9 only in that the retainer ring 87 used for mounting the exchange display part 88 is not installed, and a photovoltaic part 81 is installed on the underside of a dial 51. The photovoltaic part 81 is a solar cell. Accordingly, a battery 69 can be charged with electric energy generated by the photovoltaic part 81, and the electric energy can be accumulated in the battery 69, enabling supply of power for use inside the timepiece.

Exchange of Information between the External Apparatus and the Timepiece

Figure 15:
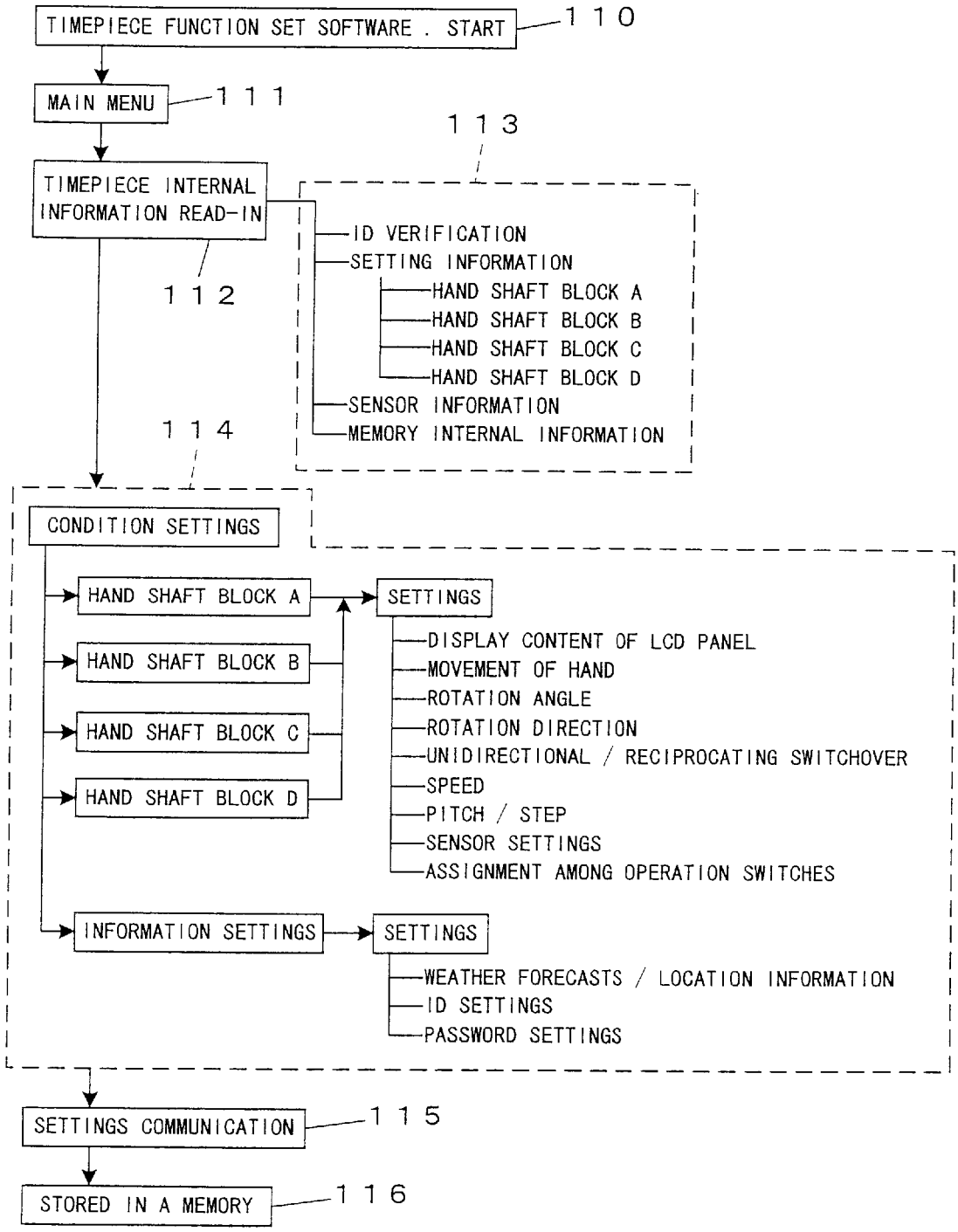
FIG. 15 is a flow sheet illustrating the steps of a process for setting functions of respective hand shaft blocks of the timepiece according to the invention by use of the external apparatus.

Referring to a flow sheet, steps of a process for performing exchange of information between the external apparatus 20 and the timepiece 1 are briefly described hereinafter. FIG. 15 is the flow sheet illustrating the steps of the process for performing exchange of information in order to set functions, and so forth of the hand shaft blocks of the timepiece 1 by use of the external apparatus 20.

First, by executing a program for performing timepiece setting with the personal computer (PC) which is the external apparatus 20, timepiece function set software 110 is started. Timepiece internal information read-in 112 is selected from a main menu 111 of the timepiece function set software. By selection and execution of the timepiece internal information read-in 112, timepiece internal information 113 on an "as is" basis is read in (transferred) from the timepiece to the PC. The timepiece internal information 113 includes verification of a timepiece identification number (ID), setting information such as current setting information on the hand shaft block A, the hand shaft block B, the hand shaft block C, and the hand shaft block D, sensor information, and memory internal information such as the used-up capacity of a memory, and so forth.

Subsequently, condition setting 114 for setting contents in the timepiece are executed. Settings for the respective hand shaft blocks A, B, C and D are displayed, and what to be displayed by the liquid crystal display panel, what movements the hands are to make, such as the rotation angles and rotation directions thereof, and whether the movements thereof are unidirectional or reciprocating are designed. Further, the speed of the hands, the pitch and step angle thereof, and which sensors to be assigned are designated. Also, which of the operation switches the settings are to be executed with is designated.

Further, as information settings, setting of weather forecasts, location information, bearings information, and so forth, or registration of the identification number of the timepiece, and setting of a password are performed. As for the weather forecasts, information obtained from Internet and the like can be utilized.

After completing the condition setting 114 described above, exchange of information (settings communication: 115) on the settings is performed between the PC and the timepiece using optical communication means or a cable. Information received from the PC is stored in a memory 116 inside the timepiece, comprising, for example, a RAM. Since information on the timepiece before communication has already been sent to the PC, only portions of the settings to be newly changed need to be modified. Thus, movements of the hands of the timepiece can be diversely modified.

Testing Means

Figure 16:
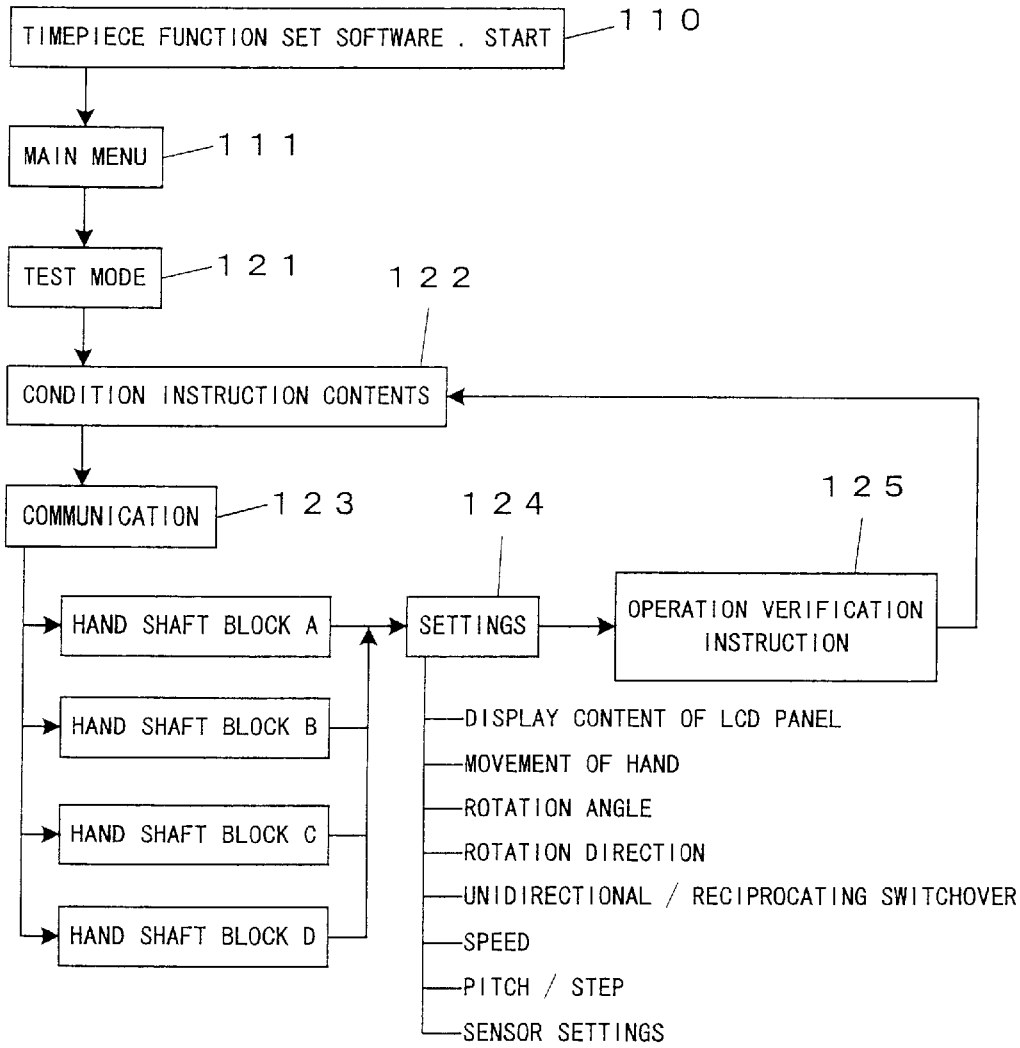
FIG. 16 is a schematic block diagram showing the steps of testing for checking conformity of operation of the timepiece according to the invention on the basis of information which has been exchanged between the timepiece and the external apparatus.

Referring to FIG. 16, steps of testing means for checking conformity of operation of the timepiece after executing exchange of information between the external apparatus 20 and the timepiece 1 for checking whether correct movement is executed by the timepiece on the basis of the contents of the information exchanged are briefly described hereinafter. FIG. 16 is a block diagram illustrating steps of testing conducted for checking conformity of operation of the timepiece according to the invention with the information after exchange thereof between the timepiece and the external apparatus.

First, by executing the program for performing the timepiece setting with the personal computer (PC) which is the external apparatus 20, the timepiece function set software 110 is started. Test mode 121 is selected from the main menu 111 of the timepiece function set software 110. By selection and execution of the test mode 121, verification of condition instruction contents 122 of a test operation is performed. Verification of settings contents 124 within the timepiece for the respective hand shaft blocks A, B, C and D is performed with the condition instruction contents is performed.

According to the invention, there are available two types of verification (testing) methods. A first method is a method whereby conformity of information in the PC with information received from the timepiece is verified by collating the respective set contents, and information of the timepiece differing from that of the PC is displayed on the monitor of the PC. The method is simple, but with the method, it is difficult to verify the operation of the respective hand shaft blocks.

A second method is a method whereby sequential verification of respective items of the settings 124 within the timepiece is performed from the PC. With the method, based on respective items of the settings 124, information is sent from the PC to the timepiece, or information from the timepiece is received by the PC, and by executing operation verification instruction 125, verification of conformity of the information within the PC with the information received from the timepiece is performed.

With the invention, a design identical to that of the timepiece is displayed on the PC. The PC causes the timepiece to display contents displayed on the liquid crystal display panel on the basis of the settings 124 within the timepiece. Verification of whether or not a design displayed on the liquid crystal display panel of the timepiece is identical to a design on the monitor of the PC is performed. Similarly, the PC sends instructions on the movement of the hands on the basis of the settings 124 within the timepiece. Verification of whether or not the movement of the hand of the respective hand shaft blocks of the timepiece is identical to virtual movement of the hand as designed and displayed on the monitor of the PC, is performed. Or at the push of one of the operation switches by the user of the timepiece, an instruction is sent from the timepiece to the PC, and the instruction to push one of virtual operation switches of a timepiece appearing on the monitor of the PC is executed, thereby performing verification of the operation of the timepiece 1 with that of a virtual timepiece.

For example, in the case of display with the pressure sensor, it is possible to verify conformity of the movement of the hand of the respective hand shaft blocks of the timepiece with the movement of the hands of the virtual timepiece on the monitor of the PC by transmitting data such as the depth of water at 10 meters, an elevation of 500 meters, and so forth from the PC to the timepiece Furthermore, since virtual testing of, for example, even items requiring verification for twelve hours in the course of general usage can be conducted through the intermediary of the PC, conformity in exchange of information between the PC and the timepiece 1 can be verified, thereby enabling the timepiece 1 to execute highly reliable exchange of information.

Timepiece Stop Set due to a Drop in Battery Voltage

Figure 17:
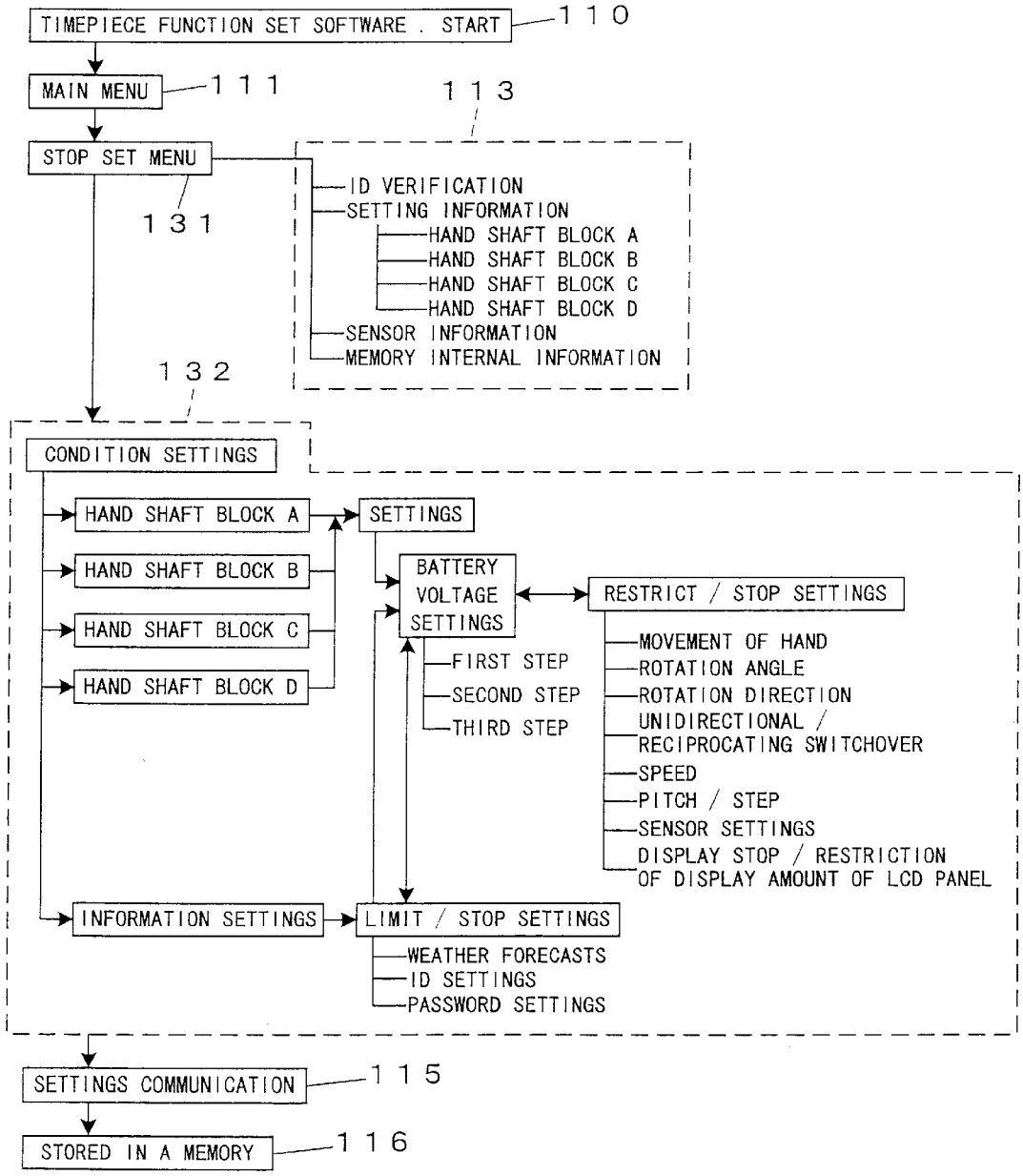
FIG. 17 is a schematic block diagram showing the steps of a process for reducing power consumption of the timepiece according to the invention when a drop in battery voltage thereof occurs.

Referring to FIG. 17, steps of a process for restricting or stopping the function of the respective hand shaft blocks of the timepiece 1 in order to cope with a drop in battery voltage or to lengthen a battery life are briefly described hereinafter. FIG. 17 is a block diagram illustrating the steps of a process for exchanging information to restrict or stop the function, and so forth of the respective hand shaft blocks of the timepiece 1 by use of the external apparatus 20.

First, by executing the program for performing the timepiece setting with the personal computer (PC) which is the external apparatus 20, the timepiece function set software 110 is started. Stop set menu 131 is selected from the main menu 111 of the timepiece function set software 110. By selection and execution of the stop set menu 131, the timepiece internal information 113 on an "as is" basis is read in (transferred) from the timepiece to the PC. The timepiece internal information 113 includes the verification of the timepiece identification number (ID), setting information such as current setting information on the hand shaft block A, the hand shaft block B, the hand shaft block C, and the hand shaft block D, the sensor information, and the memory internal information such as the used-up capacity of the memory, and so forth.

Subsequently, condition setting 132 for restricting or stopping the functions of the timepiece are executed. Settings for the respective hand shaft blocks A, B, C and D are displayed, and battery voltage setting or step-by-step (from step 1 to step 3) setting of a service period is set, thereby performing restrict/stop set so as to cope with respective battery voltage settings. As the settings of the restrict/stop set, restriction or stoppage of the movements, rotation angle, and rotation direction of the hands, and whether the movement of the hands is unidirectional or reciprocating are designated. Further, the speed, pitch and step angle of the hands are designated. Also, which sensor is to stop its function or setting of measurement intervals is designated. Further, setting of which of the operation switches is to stop function, restriction of a display amount (area/the number of pixels driven) of the liquid crystal display panel, or setting of unlighting of display is performed.

Further, for information settings, display of the weather forecasts, the location information, or bearings information on the liquid crystal display panel, and the movement of the hands are limited. Or the registration of the identification number of the timepiece, and the setting of the password are limited or stopped.

After completing designation of the condition settings described in the foregoing, exchange of information (settings communication: 115) on settings is performed between the PC and the timepiece using optical communication means or a cable. Information received from the PC is stored in the memory 116 inside the timepiece, comprising, for example, a RAM. Thus, it becomes possible to render an uptime of the timepiece variable in such a way as to cope with information required. Also, it becomes possible to lower power consumption.

In the case of stopping the respective hand shaft blocks, a method of shifting the hand to a stop position before stopping the same, a method of stopping the hand on the spot, or a method of displaying stoppage of the hand on the liquid crystal display panel are available. With the invention, the method of shifting the hand to the stop position before stopping the same is adopted. This is because stoppage can be checked easily only with the timepiece while keeping power consumption at a lower level in comparison with the other methods.

INDUSTRIAL APPLICABILITY

As described hereinbefore, with the timepiece according to the invention, information is acquired from the external apparatus via the communication means, and the functions of the timepiece can be changed on the basis of the information. In particular, display of a variety of information by the agency of the respective hand shaft blocks can be effected, and the display function of time and so forth can be changed. In addition, a problem from a design point of view can be solved, enabling implementation of a versatile timepiece suiting to preferences of users.

What is claimed is:

1. A timepiece comprising communication means for exchanging information with an external apparatus comprising a receiving means for receiving information transmitted from the timepiece and a transmitting means for transmitting setting information to the timepiece, a function selection means capable of automatically changing functions of the timepiece on the basis of information acquired from the external apparatus via the communication means, and a hand shaft control means for controlling movement of hand shafts of the timepiece in response to an instruction for function change given by the function selection means, a display means for displaying types of information displayed by a hand of the hand shafts controlled by the hand shaft control means in response to the instruction for the function change given by the function selection means;

wherein the communication means comprises a transmitting means for transmitting internal information to the external apparatus and a receiving means for receiving information transmitted from the external apparatus, and wherein the hand shaft control means is a means having a plurality of hand shaft blocks, each comprising at least one or more hand shafts and controlling a hand shaft or hand shafts of some hand shaft blocks among the plurality of the hand shaft blocks in response to the instruction for function change given by the function selection means, and for controlling a hand shaft or hand shafts of the rest of the hand shaft blocks on the basis of internal information of the timepiece not associated with the information acquired from the external apparatus, thereby displaying different information on each of the hand shaft blocks.

2. A timepiece according to claim 1 further comprising a means for making the hand shaft control means to control the hand shafts so as to display with a hand thereof that the communication means is in use for communication when the communication means is in communication with the external apparatus.

3. A timepiece according to claim 1 further comprising a means for making the display means to display that the communication means is in use for communication when the communication means is in communication with the external apparatus.

4. A timepiece according to claim 1 further comprising a rechargeable battery for supplying electric power to be used internally, wherein the communication means is wired communication means capable of receiving electric power from the external apparatus, and a charging means for charging the battery by receiving supply of electric power from the external apparatus when the communication means is in communication with the external apparatus is installed.

5. A timepiece according to claim 4 further comprising a power generation means enabling the battery to be chargeable all the time by the charging means.

6. A timepiece according to claim 4 further comprising a means for reducing power consumption by restricting control on the hand shafts operated by the function selection means and the hand shaft control means when the amount of electrical energy that remains in the battery falls short of a predetermined amount.

7. A timepiece according to claim 4 further comprising a means for displaying a state of charging when the battery is being charged by the charging means while the communication means is in communication with the external apparatus.

8. A timepiece according to claim 4 further comprising a means for making the hand shaft control means to control a hand shaft so as to display a state of charging with a hand thereof when the battery is being charged by the charging means while the communication means are in communication with the external apparatus.

9. A timepiece according to claim 1, where in the hand shaft control means comprises a means for controlling the hand shafts so as to change any of a rotation direction, rotation angle, reciprocating movement, rotation speed of hands, and a pitch at which the hands are handled, in response to the instruction for function change given by the function selection means.

10. A timepiece according to claim 1, wherein the communication means is optical communication means for performing exchange of information with the external apparatus by utilizing light.

11. A timepiece according to claim 10, wherein the optical communication means is a means disposed on an underside of a time display face for performing exchange of information with the external apparatus by an agency of light outgoing through and incident on the time display face.

12. A timepiece according to claim 11 further comprising a means for making the hand shaft control means to control the hand shaft of a hand so as to cause the hand to withdraw to a position not blocking the light outgoing through or incident on the time display face in case of the hand being in a position blocking the light upon start of communication via the optical communication means.

13. A timepiece according to claim 11, further comprising display means for displaying types of information displayed by a hand of the hand shafts controlled by the hand shaft control means, in response to the instruction for function change given by the function selection means, wherein at least part of the display means is caused to stop displaying when the optical communication means are in communication.

14. A timepiece according to claim 1 further comprising a sensor for measuring information associated with an application environment of the timepiece, and a means for making the hand shaft control means to control the hand shafts so as to display the information measured by the sensor with the hand of the hand shafts.

15. A timepiece according to claim 1 further comprising:

a sensor for measuring information associated with an application environment of the timepiece; and a means for selecting any of the hand shaft blocks controlled on the basis of internal information of the timepiece among the plurality of the hand shaft blocks, and for making the hand shaft control means to control a hand shaft or hand shafts of the hand shaft block as selected so as to display the information measured by the sensor with the hand of the hand shaft or the hand shafts.

16. A timepiece according to claim 1 further comprising a testing means for making the hand shaft control means to control the movement of the hand shafts on a trial basis for short duration on the basis of the information acquired from the external apparatus during or after communication via the communication means.

17. A timepiece according to claim 1, wherein the display means is a liquid crystal display panel.

18. A timepiece according to claim 1, wherein the display means is a printed layer formed on a visible side of a glass, and further comprising an exchange display part for making display information changeable according to the information.

19. A timepiece according to claim 18, wherein the exchange display part has a structure of fixedly attaching the printed layer on a transparent sheet to the glass with a retainer ring.

20. A timepiece according to claim 6, wherein at least one hand shaft block is stopped for reducing power consumption.

21. A timepiece comprising communication means for exchanging information with an external apparatus comprising a receiving means for receiving information transmitted from the timepiece and a transmitting means for transmitting setting information to the timepiece, a function selection means capable of automatically changing functions of the timepiece on the basis of information acquired from the external apparatus via the communication means, and a hand shaft control means for controlling movement of hand shafts of the timepiece in response to an instruction for function change given by the function selection means, wherein the communication means comprises a transmitting means for transmitting internal information to the external apparatus and a receiving means for receiving information transmitted from the external apparatus, and wherein the hand shaft control means is a means having a plurality of hand shaft blocks, each comprising at least one or more hand shafts and controlling a hand shaft or hand shafts of some hand shaft blocks among the plurality of the hand shaft blocks in response to the instruction for function change given by the function selection means, and for controlling a hand shaft or hand shafts of the rest of the hand shaft blocks on the basis of internal information of the timepiece not associated with the information acquired from the external apparatus, thereby displaying different information on each of the hand shaft blocks;

wherein the hand shaft control means comprises a means for controlling the hand shafts so as to change any of a rotation direction, rotation angle, reciprocating movement, rotation speed of hands, and a pitch at which the hands are handled, in response to the instruction for function change given by the function selection means.

* * * * *